US007397431B2

(12) United States Patent
Baliarda et al.

(10) Patent No.: US 7,397,431 B2
(45) **Date of Patent: *Jul. 8, 2008**

(54) MULTILEVEL ANTENNAE

(75) Inventors: Carles Puente Baliarda, Barcelona (ES); Carmen Borja Borau, Barcelona (ES); Jaume Anguera Pros, Barcelona (ES); Jordi Soler Castany, Mataro (ES)

(73) Assignee: Fractus, S.A., Barcelona (ES)

( * ) Notice: Subject to any disclaimer, the term of this patent is extended or adjusted under 35 U.S.C. 154(b) by 0 days.

This patent is subject to a terminal disclaimer.

(21) Appl. No.: 11/179,257

(22) Filed: Jul. 12, 2005

(65) Prior Publication Data

US 2006/0290573 A1 Dec. 28, 2006

Related U.S. Application Data

(63) Continuation of application No. 11/102,390, filed on Apr. 8, 2005, now Pat. No. 7,123,208, which is a continuation of application No. 10/963,080, filed on Oct. 12, 2004, now Pat. No. 7,015,868, which is a continuation of application No. 10/102,568, filed on Mar. 18, 2002, now abandoned, which is a continuation of application No. PCT/ES99/00296, filed on Sep. 20, 1999.

(51) Int. Cl.
*H01Q 1/24* (2006.01)

(52) U.S. Cl. ..... 343/702; 343/700 MS; 343/800

(58) Field of Classification Search ..... 343/700 MS, 343/702, 798, 800, 829, 846
See application file for complete search history.

(56) References Cited

U.S. PATENT DOCUMENTS 621,455 A 3/1899 Hess et al.

(Continued)

FOREIGN PATENT DOCUMENTS

AU 2438199 A 9/1999

(Continued)

OTHER PUBLICATIONS

Hall, P. S., "System Applications: The Challenge for Active Integrated Antennas," 5 pages, undated.

(Continued)

*Primary Examiner*—Tho Phan
(74) *Attorney, Agent, or Firm*—Howison & Arnott, L.L.P.

(57) ABSTRACT

Antennae in which the corresponding radiative element contains at least one multilevel structure formed by a set of similar geometric elements (polygons or polyhedrons) electromagnetically coupled and grouped such that in the structure of the antenna can be identified each of the basic component elements. The design is such that it provides two important advantages: the antenna may operate simultaneously in several frequencies, and/or its size can be substantially reduced. Thus, a multiband radioelectric behavior is achieved, that is, a similar behavior for different frequency bands.

37 Claims, 13 Drawing Sheets

U.S. PATENT DOCUMENTS

| | | | |
|---|---|---|---|
| 646,850 | A | 4/1900 | Lindemeyr |
| 3,079,602 | A | 2/1963 | Hamel et al. |
| 3,521,284 | A | 7/1970 | Shelton, Jr. et al. |
| 3,599,214 | A | 8/1971 | Altmayer |
| 3,605,102 | A | 9/1971 | Frye |
| 3,622,890 | A | 11/1971 | Fujimoto et al. |
| 3,683,376 | A | 8/1972 | Pronovost |
| 3,818,490 | A | 6/1974 | Leahy |
| 3,967,276 | A | 6/1976 | Goubau |
| 3,969,730 | A | 7/1976 | Fuchser |
| 4,021,810 | A | 5/1977 | Urpo et al. |
| 4,024,542 | A | 5/1977 | Ikawa et al. |
| 4,131,893 | A | 12/1978 | Munson et al. |
| 4,141,014 | A | 2/1979 | Sletten |
| 4,141,016 | A | 2/1979 | Nelson |
| 4,218,682 | A | 8/1980 | Yu |
| 4,243,990 | A | 1/1981 | Nemit et al. |
| 4,290,071 | A | 9/1981 | Fenwick |
| 4,471,358 | A | 9/1984 | Glasser |
| 4,471,493 | A | 9/1984 | Schober |
| 4,504,834 | A | 3/1985 | Garay et al. |
| 4,517,572 | A | 5/1985 | Dixon |
| 4,518,968 | A | 5/1985 | Hately |
| 4,521,784 | A | 6/1985 | Nemet |
| 4,527,164 | A | 7/1985 | Cestaro et al. |
| 4,531,130 | A | 7/1985 | Powers et al. |
| 4,543,581 | A | 9/1985 | Nemet |
| 4,553,146 | A | 11/1985 | Butler |
| 4,571,595 | A | 2/1986 | Phillips et al. |
| 4,584,709 | A | 4/1986 | Kneisel et al. |
| 4,590,614 | A | 5/1986 | Erat |
| 4,623,894 | A | 11/1986 | Lee et al. |
| 4,656,642 | A | 4/1987 | Apostolos et al. |
| 4,673,948 | A | 6/1987 | Kuo |
| 4,709,239 | A | 11/1987 | Herrick |
| 4,723,305 | A | 2/1988 | Phillips et al. |
| 4,730,195 | A | 3/1988 | Phillips et al. |
| 4,792,809 | A | 12/1988 | Gilbert et al. |
| 4,794,396 | A | 12/1988 | Pothier |
| 4,799,156 | A | 1/1989 | Shavit et al. |
| 4,839,660 | A | 6/1989 | Hadzoglou |
| 4,843,468 | A | 6/1989 | Drewery |
| 4,847,629 | A | 7/1989 | Shimazaki |
| 4,849,766 | A | 7/1989 | Inaba et al. |
| 4,857,939 | A | 8/1989 | Shimazaki |
| 4,890,114 | A | 12/1989 | Egashira |
| 4,894,663 | A | 1/1990 | Urbish et al. |
| 4,907,011 | A | 3/1990 | Kuo |
| 4,912,481 | A | 3/1990 | Mace et al. |
| 4,975,711 | A | 12/1990 | Lee |
| 5,030,963 | A | 7/1991 | Tadama |
| 5,033,385 | A | 7/1991 | Zeren |
| 5,046,080 | A | 9/1991 | Lee et al. |
| 5,061,944 | A | 10/1991 | Powers et al. |
| 5,074,214 | A | 12/1991 | Zeren |
| 5,138,328 | A | 8/1992 | Zibrik et al. |
| 5,164,980 | A | 11/1992 | Bush et al. |
| 5,168,472 | A | 12/1992 | Lockwood |
| 5,172,084 | A | 12/1992 | Fiedziuszko et al. |
| 5,197,140 | A | 3/1993 | Blamer |
| 5,200,756 | A | 4/1993 | Feller |
| 5,210,542 | A | 5/1993 | Pett et al. |
| 5,212,742 | A | 5/1993 | Normile et al. |
| 5,212,777 | A | 5/1993 | Gove et al. |
| 5,214,434 | A | 5/1993 | Hau |
| 5,218,370 | A | 6/1993 | Blaese |
| 5,227,804 | A | 7/1993 | Oda |
| 5,227,808 | A | 7/1993 | Davis |
| 5,245,350 | A | 9/1993 | Sroka |
| 5,248,988 | A | 9/1993 | Makino |
| 5,255,002 | A | 10/1993 | Day |
| 5,257,032 | A | 10/1993 | Diamond et al. |
| 5,258,765 | A | 11/1993 | Dorrie et al. |
| 5,262,791 | A | 11/1993 | Tsuda et al. |
| 5,300,936 | A | 4/1994 | Izadian |
| 5,307,075 | A | 4/1994 | Huynh |
| 5,337,063 | A | 8/1994 | Takahira |
| 5,337,065 | A | 8/1994 | Bonnet |
| 5,347,291 | A | 9/1994 | Moore |
| 5,355,144 | A | 10/1994 | Walton et al. |
| 5,355,318 | A | 10/1994 | Dionnet et al. |
| 5,363,114 | A | 11/1994 | Shoemaker |
| 5,373,300 | A | 12/1994 | Jenness et al. |
| 5,394,163 | A | 2/1995 | Bullen et al. |
| 5,402,134 | A | 3/1995 | Miller et al. |
| 5,420,599 | A | 5/1995 | Erkocevic |
| 5,422,651 | A | 6/1995 | Chang |
| 5,438,357 | A | 8/1995 | McNelley |
| 5,451,965 | A | 9/1995 | Matsumoto |
| 5,451,968 | A | 9/1995 | Emery |
| 5,453,751 | A | 9/1995 | Tsukamoto et al. |
| 5,457,469 | A | 10/1995 | Diamond et al. |
| 5,471,224 | A | 11/1995 | Barkeshli |
| 5,493,702 | A | 2/1996 | Crowley et al. |
| 5,495,261 | A | 2/1996 | Baker et al. |
| 5,508,709 | A | 4/1996 | Krenz et al. |
| 5,534,877 | A | 7/1996 | Sorbello et al. |
| 5,537,367 | A | 7/1996 | Lockwood et al. |
| 5,559,524 | A | 9/1996 | Takei et al. |
| 5,563,882 | A | 10/1996 | Bruno et al. |
| 5,569,879 | A | 10/1996 | Gloton et al. |
| 5,572,223 | A | 11/1996 | Phillips |
| H1631 | H | 2/1997 | Montgomery et al. |
| 5,600,844 | A | 2/1997 | Shaw et al. |
| 5,619,205 | A | 4/1997 | Johnson |
| 5,621,913 | A | 4/1997 | Tuttle et al. |
| 5,627,550 | A | 5/1997 | Sanad |
| 5,646,635 | A | 7/1997 | Cockson et al. |
| 5,646,637 | A | 7/1997 | Miller |
| 5,657,028 | A | 8/1997 | Sanad |
| 5,672,345 | A | 9/1997 | Curtiss, III |
| 5,680,144 | A | 10/1997 | Sanad |
| 5,684,672 | A | 11/1997 | Karidis et al. |
| 5,703,600 | A | 12/1997 | Burrell et al. |
| 5,710,458 | A | 1/1998 | Iwasaki |
| 5,712,640 | A | 1/1998 | Andou et al. |
| 5,734,352 | A | 3/1998 | Seward et al. |
| 5,742,258 | A | 4/1998 | Kumpfbeck et al. |
| 5,764,190 | A | 6/1998 | Murch et al. |
| 5,767,811 | A | 6/1998 | Mandai et al. |
| 5,767,814 | A | 6/1998 | Conroy et al. |
| 5,790,080 | A | 8/1998 | Apostolos |
| 5,798,688 | A | 8/1998 | Schofield |
| 5,805,113 | A | 9/1998 | Ogino et al. |
| 5,808,586 | A | 9/1998 | Phillips et al. |
| 5,821,907 | A | 10/1998 | Zhu et al. |
| 5,841,403 | A | 11/1998 | West |
| 5,861,845 | A | 1/1999 | Lee et al. |
| 5,870,066 | A | 2/1999 | Asakura et al. |
| 5,872,546 | A | 2/1999 | Ihara et al. |
| 5,898,404 | A | 4/1999 | Jou |
| 5,903,240 | A | 5/1999 | Kawahata et al. |
| 5,913,174 | A | 6/1999 | Casarez et al. |
| 5,926,139 | A | 7/1999 | Korisch |
| 5,926,141 | A | 7/1999 | Lindenmeier et al. |
| 5,926,208 | A | 7/1999 | Noonen et al. |
| 5,929,822 | A | 7/1999 | Kumpfbeck et al. |
| 5,936,583 | A | 8/1999 | Sekine et al. |
| 5,943,020 | A | 8/1999 | Liebendoerfer et al. |
| 5,945,954 | A | 8/1999 | Johnson |
| 5,963,871 | A | 10/1999 | Zhinong et al. |
| 5,966,097 | A | 10/1999 | Fukasawa |
| 5,966,098 | A | 10/1999 | Qi et al. |
| 5,969,689 | A | 10/1999 | Martek |

5,973,648 A 10/1999 Lindenmeier et al.
5,973,651 A 10/1999 Suesada et al.
5,982,337 A 11/1999 Newman et al.
5,986,609 A 11/1999 Spall
5,986,610 A 11/1999 Miron
5,986,615 A 11/1999 Westfall et al.
5,990,838 A 11/1999 Burns et al.
6,002,367 A 12/1999 Engblom et al.
6,005,524 A 12/1999 Hayes et al.
6,008,764 A 12/1999 Ollikainen et al.
6,008,774 A 12/1999 Wu
6,011,518 A 1/2000 Yamagishi et al.
6,014,114 A 1/2000 Westfall et al.
6,018,319 A 1/2000 Lindmark
6,028,568 A 2/2000 Asakura et al.
6,031,495 A 2/2000 Simmons et al.
6,031,499 A 2/2000 Dichter
6,031,505 A 2/2000 Qi et al.
6,034,645 A 3/2000 Legay et al.
6,037,902 A 3/2000 Pinhas et al.
6,039,583 A 3/2000 Korsunsky et al.
6,040,803 A 3/2000 Spall
6,043,783 A 3/2000 Endo et al.
6,049,314 A 4/2000 Munson et al.
6,054,953 A 4/2000 Lindmark
6,057,801 A 5/2000 Desclos et al.
6,069,592 A 5/2000 Wass
6,072,434 A 6/2000 Papatheodorou
6,075,485 A 6/2000 Lilly et al.
6,075,500 A 6/2000 Kurz et al.
6,078,294 A 6/2000 Mitarai
6,081,237 A 6/2000 Sato et al.
6,087,990 A 7/2000 Thill et al.
6,091,365 A 7/2000 Derneryd et al.
6,097,345 A 8/2000 Walton
6,100,855 A 8/2000 Vinson et al.
6,104,349 A 8/2000 Cohen
6,107,920 A 8/2000 Eberhardt et al.
6,111,545 A 8/2000 Saari
6,112,102 A 8/2000 Zhinong
6,114,674 A 9/2000 Baugh et al.
6,122,533 A 9/2000 Zhang et al.
6,124,830 A 9/2000 Yuanzhu
6,127,977 A 10/2000 Cohen
6,131,042 A 10/2000 Lee et al.
6,133,883 A 10/2000 Munson et al.
6,140,969 A 10/2000 Lindenmeier et al.
6,140,975 A 10/2000 Cohen
6,147,652 A 11/2000 Sekine
6,147,655 A 11/2000 Roesner
6,154,180 A 11/2000 Padrick
6,157,348 A 12/2000 Openlander
6,160,513 A 12/2000 Davidson et al.
6,166,694 A 12/2000 Ying
6,172,618 B1 1/2001 Hakozaki et al.
6,175,333 B1 1/2001 Smith et al.
6,181,281 B1 1/2001 Desclos et al.
6,195,048 B1 2/2001 Chiba et al.
6,198,943 B1 3/2001 Sadler et al.
6,211,824 B1 4/2001 Holden et al.
6,211,834 B1 4/2001 Durham et al.
6,211,889 B1 4/2001 Stoutamire
6,215,447 B1 4/2001 Johnson
6,218,989 B1 4/2001 Schneider et al.
6,218,991 B1 4/2001 Sanad
6,218,992 B1 4/2001 Sadler et al.
6,222,497 B1 4/2001 Hu et al.
6,236,372 B1 5/2001 Lindenmeier et al.
6,239,752 B1 5/2001 Blanchard
6,239,765 B1 5/2001 Johnson
6,255,994 B1 7/2001 Saito
6,255,995 B1 7/2001 Asano et al.
6,260,088 B1 7/2001 Gove et al.
6,266,023 B1 7/2001 Nagy et al.
6,266,538 B1 7/2001 Waldron
6,268,836 B1 7/2001 Faulkner et al.
6,271,794 B1 8/2001 Geeraert
6,281,846 B1 8/2001 Puente Baliarda et al.
6,285,326 B1 9/2001 Diximus et al.
6,285,342 B1 9/2001 Brady et al.
6,292,154 B1 9/2001 Deguchi et al.
6,297,711 B1 10/2001 Seward et al.
6,300,910 B1 10/2001 Kim
6,300,914 B1 10/2001 Yang
6,304,220 B1 10/2001 Herve et al.
6,304,222 B1 10/2001 Smith et al.
6,307,511 B1 10/2001 Ying et al.
6,307,512 B1 10/2001 Geeraert
6,317,083 B1 11/2001 Johnson et al.
6,320,543 B1 11/2001 Ohata et al.
6,323,811 B1 11/2001 Tsubaki et al.
6,326,919 B1 12/2001 Diximus et al.
6,326,927 B1 12/2001 Johnson et al.
6,327,485 B1 12/2001 Waldron
6,329,951 B1 12/2001 Wen et al.
6,329,954 B1 12/2001 Fuchs et al.
6,329,962 B2 12/2001 Ying
6,333,716 B1 12/2001 Pontoppidan
6,333,720 B1 12/2001 Gottl et al.
6,342,861 B1 1/2002 Packard
6,343,208 B1 1/2002 Ying
6,346,914 B1 2/2002 Annamaa
6,348,892 B1 2/2002 Annamaa et al.
6,351,241 B1 2/2002 Wass
6,353,443 B1 3/2002 Ying
6,360,105 B2 3/2002 Nakada et al.
6,362,790 B1 3/2002 Proctor, Jr. et al.
6,366,243 B1 4/2002 Isohatala
6,367,939 B1 4/2002 Carter et al.
6,373,447 B1 4/2002 Rostoker et al.
6,377,217 B1 4/2002 Zhu et al.
6,380,895 B1 4/2002 Moren et al.
6,384,790 B2 5/2002 Dishart
6,384,793 B2 5/2002 Scordilis
6,388,626 B1 5/2002 Gamalielsson et al.
6,400,339 B1 6/2002 Edvardsson et al.
6,407,710 B2 6/2002 Keilen et al.
6,408,190 B1 6/2002 Ying
6,417,810 B1 7/2002 Huels et al.
6,417,816 B2 7/2002 Sadler et al.
6,421,024 B1 7/2002 Stolle
6,424,315 B1 7/2002 Glenn et al.
6,429,818 B1 8/2002 Johnson et al.
6,431,712 B1 8/2002 Turnbull
6,445,352 B1 9/2002 Cohen
6,452,549 B1 9/2002 Lo
6,452,553 B1 9/2002 Cohen
6,456,249 B1 9/2002 Johnson et al.
6,470,174 B1 10/2002 Schefte et al.
6,476,766 B1 11/2002 Cohen
6,483,462 B2 11/2002 Weinberger
6,492,952 B1 12/2002 Hu
6,498,586 B2 12/2002 Pankinaho
6,498,588 B1 12/2002 Callaghan
6,525,691 B2 2/2003 Varadan et al.
6,538,604 B1 3/2003 Isohätälä et al
6,539,608 B2 4/2003 McKinnon et al.
6,545,640 B1 4/2003 Herve et al.
6,552,690 B2 4/2003 Veerasamy
6,628,784 B1 9/2003 Montane Condemines
6,693,603 B1 2/2004 Smith et al.
6,741,210 B2 5/2004 Brachat et al.
6,831,606 B2 12/2004 Sajadinia
7,095,372 B2 * 8/2006 Soler Castany et al. ..... 343/700 MS
2001/0011964 A1 8/2001 Sadler et al.

| | | | | |
|---|---|---|---|---|
| 2001/0018793 | A1 | 9/2001 | McKinnon et al. | |
| 2001/0050635 | A1 | 12/2001 | Weinberger | |
| 2001/0050636 | A1 | 12/2001 | Weinberger | |
| 2001/0050638 | A1 | 12/2001 | Ishitobi et al. | |
| 2002/0000940 | A1 | 1/2002 | Moren et al. | |
| 2002/0000942 | A1 | 1/2002 | Duroux | |
| 2002/0036594 | A1 | 3/2002 | Gyenes | |
| 2002/0058539 | A1 | 5/2002 | Underbrink et al. | |
| 2002/0105468 | A1 | 8/2002 | Tessier et al. | |
| 2002/0109633 | A1 | 8/2002 | Ow et al. | |
| 2002/0126054 | A1 | 9/2002 | Fuerst et al. | |
| 2002/0126055 | A1 | 9/2002 | Lindenmeier et al. | |
| 2002/0171601 | A1 | 11/2002 | Puente Baliarda | |
| 2002/0175866 | A1 | 11/2002 | Gram | |
| 2002/0190904 | A1 | 12/2002 | Cohen | |
| 2003/0160723 | A1 | 8/2003 | Cohen | |
| 2003/0201942 | A1 | 10/2003 | Poilasne | |
| 2004/0145529 | A1 | 7/2004 | Iguchi et al. | |
| 2005/0116873 | A1* | 6/2005 | Soler Castany et al. | 343/795 |
| 2005/0259009 | A1* | 11/2005 | Puente Baliarda et al. | 343/700 MS |
| 2006/0033664 | A1* | 2/2006 | Soler Castany et al. | 343/700 MS |
| 2006/0077101 | A1* | 4/2006 | Puente Baliarda et al. | 343/700 MS |

FOREIGN PATENT DOCUMENTS

| | | | |
|---|---|---|---|
| CA | 2 416 437 | A1 | 1/2002 |
| DE | 33 37 941 | A1 | 5/1985 |
| DE | 195 11 300 | A1 | 10/1996 |
| DE | 199 29 689 | A1 | 1/2001 |
| DE | 102 06 426 | A1 | 11/2002 |
| DE | 101 38 265 | A1 | 7/2003 |
| DE | 102 04 079 | A1 | 8/2003 |
| EP | 0096847 | A2 | 12/1983 |
| EP | 0 297 813 | A2 | 6/1988 |
| EP | 0 358 090 | A1 | 8/1989 |
| EP | 0 431 764 | A2 | 6/1991 |
| EP | 0 543 645 | A1 | 5/1993 |
| EP | 0 571 124 | A1 | 11/1993 |
| EP | 0 688 040 | A2 | 12/1995 |
| EP | 1515392 | | 8/1996 |
| EP | 0 749 176 | A1 | 12/1996 |
| EP | 0 753 897 | A2 | 1/1997 |
| EP | 0 765 001 | A1 | 3/1997 |
| EP | 0 814 536 | A2 | 12/1997 |
| EP | 0 856 907 | A1 | 8/1998 |
| EP | 0 871 238 | A2 | 10/1998 |
| EP | 0 892 459 | A1 | 1/1999 |
| EP | 0 902 472 | A2 | 3/1999 |
| EP | 0 929 121 | A1 | 7/1999 |
| EP | 0 932 219 | A2 | 7/1999 |
| EP | 0 942 488 | A2 | 9/1999 |
| EP | 0 969 375 | A2 | 1/2000 |
| EP | 0 986 130 | A2 | 3/2000 |
| EP | 0 993 070 | A1 | 4/2000 |
| EP | 0 997 974 | A1 | 5/2000 |
| EP | 1 018 777 | A2 | 7/2000 |
| EP | 1 018 779 | A2 | 7/2000 |
| EP | 1 024 552 | A2 | 8/2000 |
| EP | 1 026 774 | A2 | 8/2000 |
| EP | 1 063 721 | A1 | 12/2000 |
| EP | 1 067 627 | A1 | 1/2001 |
| EP | 1 071 161 | A1 | 1/2001 |
| EP | 1 077 508 | A2 | 2/2001 |
| EP | 1 077 508 | A3 | 2/2001 |
| EP | 1 079 462 | A2 | 2/2001 |
| EP | 1 083 624 | A2 | 3/2001 |
| EP | 1 094 545 | A2 | 4/2001 |
| EP | 1 096 602 | A1 | 5/2001 |
| EP | 1 148 581 | A1 | 10/2001 |
| EP | 1 198 027 | A1 | 4/2002 |
| EP | 1 237 224 | A1 | 9/2002 |
| EP | 1 267 438 | A1 | 12/2002 |
| EP | 1 317 018 | A2 | 6/2003 |
| EP | 1 326 302 | A2 | 7/2003 |
| EP | 1 378 961 | A2 | 1/2004 |
| EP | 1 396 906 | A1 | 3/2004 |
| EP | 1 401 050 | A1 | 3/2004 |
| EP | 1 414 106 | A1 | 4/2004 |
| EP | 1 424 747 | A1 | 6/2004 |
| EP | 1 443 595 | A1 | 8/2004 |
| EP | 1 453 140 | A1 | 9/2004 |
| EP | 1 465 291 | A1 | 10/2004 |
| ES | 2 112 163 | | 3/1998 |
| ES | 2 142 280 | A1 | 5/1998 |
| ES | 009902216 | | 7/2001 |
| FR | 2 543 744 | A1 | 10/1984 |
| FR | 2 704 359 | A1 | 10/1994 |
| FR | 2 837 339 | | 9/2003 |
| GB | 2 161 026 | A | 1/1986 |
| GB | 2 215 136 | A | 9/1989 |
| GB | 2 289 163 | A | 11/1995 |
| GB | 2 330 951 | A | 5/1999 |
| GB | 2 355 116 | A | 4/2001 |
| GB | 2 361 584 | A | 10/2001 |
| JP | 55-147806 | A | 11/1980 |
| JP | 5-7109 | | 1/1993 |
| JP | 5-129816 | | 5/1993 |
| JP | 5-267916 | | 10/1993 |
| JP | 5-347507 | | 12/1993 |
| JP | 6-204908 | | 7/1994 |
| JP | 9-252214 | | 9/1997 |
| JP | 10-93332 | | 4/1998 |
| JP | 10-209744 | | 8/1998 |
| JP | 11-88032 | | 3/1999 |
| JP | 11-317610 | A | 11/1999 |
| JP | 2003 28 3230 | | 10/2003 |
| NZ | 508835 | | 4/2001 |
| RU | 2 170 478 | C1 | 7/2001 |
| SE | 518 988 | C2 | 12/2002 |
| TW | 5 545 71 | B | 9/2003 |
| WO | WO93/12559 | A1 | 6/1993 |
| WO | WO94/24722 | A1 | 10/1994 |
| WO | WO94/24723 | A1 | 10/1994 |
| WO | WO95/05012 | A1 | 2/1995 |
| WO | WO95/11530 | A1 | 4/1995 |
| WO | WO96/03783 | A1 | 2/1996 |
| WO | WO96/04691 | A1 | 2/1996 |
| WO | WO96/10276 | A1 | 4/1996 |
| WO | WO96/27219 | A1 | 9/1996 |
| WO | WO96/29755 | A1 | 9/1996 |
| WO | WO96/38881 | A1 | 12/1996 |
| WO | WO97/06578 | A1 | 2/1997 |
| WO | WO97/11507 | A1 | 3/1997 |
| WO | WO97/32355 | A1 | 9/1997 |
| WO | WO97/33338 | A1 | 9/1997 |
| WO | WO97/35360 | A1 | 9/1997 |
| WO | WO97/47054 | A1 | 12/1997 |
| WO | WO98/12771 | A1 | 3/1998 |
| WO | WO98/33234 | A1 | 7/1998 |
| WO | WO98/36469 | A1 | 8/1998 |
| WO | WO98/39814 | A1 | 9/1998 |
| WO | WO99/03166 | A1 | 1/1999 |
| WO | WO99/03167 | A1 | 1/1999 |
| WO | WO99/03168 | A1 | 1/1999 |
| WO | WO99/25042 | A1 | 5/1999 |
| WO | WO99/25044 | A1 | 5/1999 |
| WO | 9931757 | | 6/1999 |
| WO | WO99/27607 | A1 | 6/1999 |
| WO | WO99/27608 | A1 | 6/1999 |
| WO | WO99/35691 | A1 | 7/1999 |
| WO | WO99/56345 | A1 | 11/1999 |
| WO | WO99/57785 | A1 | 11/1999 |
| WO | WO99/60665 | A1 | 11/1999 |

| | | | |
|---|---|---|---|
| WO | WO99/62139 | A1 | 12/1999 |
| WO | WO 00/01028 | A1 | 1/2000 |
| WO | WO 00/03451 | A1 | 1/2000 |
| WO | WO 00/03453 | A1 | 1/2000 |
| WO | WO 00/22695 | A1 | 4/2000 |
| WO | WO 00/30267 | A1 | 5/2000 |
| WO | WO 00/31825 | A1 | 6/2000 |
| WO | WO 00/36700 | A1 | 6/2000 |
| WO | WO 00/49680 | A1 | 8/2000 |
| WO | 0055939 | | 9/2000 |
| WO | WO 00/52784 | A1 | 9/2000 |
| WO | WO 00/52787 | A1 | 9/2000 |
| WO | WO 00/57511 | A1 | 9/2000 |
| WO | WO 00/08712 | A1 | 12/2000 |
| WO | WO 00/74172 | A1 | 12/2000 |
| WO | WO 00/77884 | A1 | 12/2000 |
| WO | WO 01/03238 | A1 | 1/2001 |
| WO | WO 01/05048 | A1 | 1/2001 |
| WO | WO 01/06594 | A1 | 1/2001 |
| WO | WO 01/08255 | A1 | 2/2001 |
| WO | WO 01/08257 | A1 | 2/2001 |
| WO | WO 01/08260 | A1 | 2/2001 |
| WO | WO 01/09976 | A1 | 2/2001 |
| WO | WO 01/11721 | A1 | 2/2001 |
| WO | WO 01/13464 | A1 | 2/2001 |
| WO | WO 01/15270 | A1 | 3/2001 |
| WO | WO 01/15271 | A1 | 3/2001 |
| WO | WO 01/17061 | A1 | 3/2001 |
| WO | WO 01/17063 | A1 | 3/2001 |
| WO | WO 01/17064 | A1 | 3/2001 |
| WO | WO 01/18904 | A1 | 3/2001 |
| WO | WO 01/18909 | A1 | 3/2001 |
| WO | WO 01/20714 | A1 | 3/2001 |
| WO | WO 01/20927 | A1 | 3/2001 |
| WO | WO 01/22528 | A1 | 3/2001 |
| WO | 0124314 | A1 | 4/2001 |
| WO | WO 01/24314 | A1 | 4/2001 |
| WO | WO 01/24316 | A1 | 4/2001 |
| WO | WO 01/26182 | A1 | 4/2001 |
| WO | WO 01/28035 | A1 | 4/2001 |
| WO | WO 01/29927 | A1 | 4/2001 |
| WO | WO 01/31739 | A1 | 5/2001 |
| WO | WO 01/33665 | A1 | 5/2001 |
| WO | WO 01/35491 | A1 | 5/2001 |
| WO | WO 01/37369 | A1 | 5/2001 |
| WO | WO 01/37370 | A1 | 5/2001 |
| WO | WO 01/39321 | A1 | 5/2001 |
| WO | WO 01/41252 | A1 | 6/2001 |
| WO | WO 01/48861 | A1 | 7/2001 |
| WO | WO 01/54225 | A1 | 7/2001 |
| WO | WO 01/65636 | A1 | 9/2001 |
| WO | WO 01/73890 | A1 | 10/2001 |
| WO | WO 01/78192 | A2 | 10/2001 |
| WO | WO 01/82410 | A1 | 11/2001 |
| WO | WO 01/86753 | A1 | 11/2001 |
| WO | WO 01/89031 | A1 | 11/2001 |
| WO | WO 02/01668 | A2 | 1/2002 |
| WO | WO 02/35646 | A1 | 5/2002 |
| WO | WO 02/35652 | A1 | 5/2002 |
| WO | WO 02/054538 | A1 | 7/2002 |
| WO | WO 02/065583 | A1 | 8/2002 |
| WO | WO 02/071535 | A1 | 9/2002 |
| WO | WO 02/078123 | A1 | 10/2002 |
| WO | WO 02/078124 | A1 | 10/2002 |
| WO | WO 02/080306 | A1 | 10/2002 |
| WO | WO 02/087014 | A1 | 10/2002 |
| WO | WO 02/089254 | A1 | 11/2002 |
| WO | WO 02/091518 | A1 | 11/2002 |
| WO | WO 02/096166 | A1 | 11/2002 |
| WO | WO 02/103843 | A1 | 12/2002 |
| WO | WO 03/003503 | A2 | 1/2003 |
| WO | WO 03/017421 | A2 | 2/2003 |
| WO | WO 03/023900 | A1 | 3/2003 |
| WO | WO 03/026064 | A1 | 3/2003 |

OTHER PUBLICATIONS

Puente, Carles et al., "Fractal Shaped Antennas," Chapter 2, IEEE Press, pp. 48-50, undated.

Romeu, Jordi et al., Abstract of "Small Fractal Antennas," pp. 35-36, undated.

Soler, J. et al., "Solutions to Tailor the Radiation Patterns of 2D and 3D Multiband Antennas based on the Sierpinski Fractal," 1 page, undated.

Werner, Douglas H. et al., "The Theory and Design of Fractal Antenna Arrays," Frontiers in Electromagnetics, IEEE Press, Chapter 3, pp. 94-95, undated.

H. Meinke and F.V. Gundlah, "Radio Engineering Reference" (book), vol. I: Radio components, Circuits with lumped parameters, Transmission lines, Wave-guides, Resonators, Arrays, Radio waves propagation, States Energy Publishing House, Moscow (with English Translation), 4 pages, 1961. English Summary.

V. A. Volgov, "Parts and Units of Radio Electronic Equipment (Design & Computation),"Energiya, Moscow (with English translation), 4 pages, 1967. English Summary.

Hansen, R. C., "Fundamental Limitations in Antennas," Proceedings of the IEEE, vol. 69, No. 2, pp. 170-182, Feb. 1981.

Jaggard, Dwight L., "Fractal Electrodynamics and Modeling," Directions in Electromagnetic Wave Modeling, pp. 435-446, 1991.

Parker, et al., "Convoluted array elements and reduced size unit cells for frequency-selective surfaces," IEEE Proceedings H, vol. 138, No. 1, pp. 19-22, Feb. 1991.

Ali, M. et al., "A Triple-Band Internal Antenna for Mobile Hand-held Terminals," IEEE, pp. 32-35, 1992.

Zhang, Dawei et al., "Narrowband Lumped-Element Microstrip Filters Using Capacitively-Loaded Inductors," IEEE MTT-S Microwave Symposium Digest, pp. 379-382, May 16, 1995.

Griffin, Donald W. et al., "Electromagnetic Design Aspects of Pacages for Monolithic Microwave Integrated Circuit-Based Arrays with Integrated Antenna Elements," IEEE Transactions on Antennas and Propagation, vol. 43, No. 9, pp. 927-931, Sep. 1995.

Puente, C. et al., "Fractal Multiband Antenna Based on the Sierpinski Gasket," Electronics Letters, vol. 32, No. 1, pp. 1-2, Jan. 4, 1996.

Puente-Baliarda, Carles et al., "Fractal Design of Multiband and Low Side-Lobe Arrays," IEEE Transactions on Antennas and Propagation, vol. 44, No. 5, pp. 730-739, May 1996.

Sanad, Mohamed, "A Compact Dual-Broadband Microstrip Antenna Having Both Stacked and Planar Parasitic Elements," IEEE Antennas and Propagation Society International Symposium 1996 Digest, pp. 6-9, Jul. 21-26, 1996.

Puente, C. et al., "Perturbation of the Sierpinski Antenna to Allocate Operating Bands," Electronics Letters, vol. 32, No. 24, pp. 2186-2187, Nov. 21, 1996.

Puente, C. et al., "Multiband Properties of a Fractal Tree Antenna Generated by Electrochemical Deposition," Electronics Letters, IEEE, Stevenage, GB, vol. 32, No. 25, pp. 2298-2299, Dec. 5, 1996.

Puente, C. et al., "Multiband Fractal Antennas and Arrays," Fractals in Engineering from Theory to Industrial Applications, Editors: J. L. Vehel, F. Lutton and C. Tricot, Springer, New York, pp. 222-236, 1997.

Cohen, Nathan, "Fractal Antenna Applications in Wireless Telecommunications," Electronics Industries Forum of New England, 1997. Professional Program Proceedings, Boston, Massachusetts, May 6-8, 1997, New York, NY, IEEE, pp. 43-49, May 6, 1997.

Puente, C. et al., "Multiband Fractal Antennas and Arrays," Fractals in Engineering Conference, INRIA Rocquencourt, Arachon, France, 4 pages, Jun. 1997.

Gough, C. E. et al., "High To Coplanar Resonators for Microwave Applications and Scientific Studies," Physica C, NL, North-Holland Publishing, Amsterdam, vol. 282-287, No. 2001, pp. 395-398, Aug. 1, 1997.

Tanidokoro, Hiroaki et al., "I-Wavelength Loop Type Dielectric Chip Antennas," IEEE, pp. 1950-1953, 1998.

Puente, C. et al., "Small But Long Koch Fractal Monopole," Electronics Letters, IEEE, Stevenage, GB, vol. 34, No. 1, pp. 9-10, Jan. 8, 1998.

Papapolymerou, Ioannis et al., "Micromachined Patch Antennas," IEEE Transactions on Antennas and Propagation, vol. 46, No. 2, pp. 275-283, Feb. 1998.
Puente-Baliarda, Carles, et al., "On the Behavior of the Sierpinski Multiband Fractal Antenna," IEEE Transactions on Antennas and Propagation, vol. 46, No. 4, pp. 517-524, Apr. 1998.
Borja, C. et al., "Iteractive Network Model to Predict the Behaviour of a Sierpinski Fractal Network," Electronics Letters, vol. 34, No. 15, pp. 1443-1445, Jul. 23, 1998.
Samavati, Hirad et al., "Fractal Capacitors," IEEE Journal of Solid-State Circuits, vol. 33, No. 12, pp. 2035-2041, Dec. 1998.
Hohlfeld, Robert G. et al., "Self-Similarity and the Geometric Requirements for Frequency Independence in Antennae," Fractals, vol. 7, No. 1, pp. 79-84, 1999.
Im, Kihong et al., "Integrated Dipole Antennas on Silicon Substrates for Intra-Chip Communication," IEEE, 4 pages, 1999.
Pribetich, P. et al., "Quasifractal Planar Microstrip Resonators for Microwave Circuits," Microwave and Optical Technology Letters, vol. 21, No. 6, pp. 433-436, Jun. 20, 1999.
Anguera, Jaume et al., A Procedure to Design Wide-Band Electromagnetically-Coupled Stacked Microstrip Antennas Based on a Simple Network Model, IEEE Antennas & Propagation, URSI Symposium Meeting, Orlando, Florida, 4 pages, Jul. 1999.
Borja, C. et al., "Iterative Network Models to Predict the Performance of Sierpinski Fractal Antennas and Networks," IEEE Antennas & Propagation, URSI Symposium Meeting, Orlando, 3 pages, Jul. 1999.
Navarro, M. et al., "Self-similar Surface Current Distribution on Fractal Sierpinski Antenna Verified with Infra-red Thermograms," IEEE Antennas & Propagation, URSI Symposium Meeting, Orlando, Florida, pp. 1566-1569, Jul. 1999.
Gonzalez, J. M. et al., "Active Zone Self-Similarity of Fractal-Sierpinski Antenna Verified Using Infra-Red Thermograms," Electronics Letters, vol. 35, No. 17, pp. 1393-1394, Aug. 19, 1999.
Puente Baliarda, Carles et al., "The Koch Monopole: A Small Fractal Antenna," IEEE Transactions on Antennas and Propagation, New York, vol. 48, No. 11, Nov. 1, 2000, pp. 1773-1781.
Anguera, J. et al., "Miniature Wideband Stacked Microstrip Patch Antenna Based on the Sierpinski Fractal Geometry," IEEE Antennas and Propagation Society International Symposium, Salt Lake City, Utah, 2000 Digest Aps., vol. 3 of 4, pp. 1700-1703, Jul. 16, 2000.
Hara Prasad, R.V. et al., "Microstrip Fractal Patch Antenna for Multi-Band Communication," Electronics Letters, IEEE, Stevenage, GB, vol. 36, No. 14, pp. 1179-1180, Jul. 6, 2000.
Borja, C. et al., "High Directivity Fractal Boundary Microstrip Patch Antenna," Electronics Letters, IEEE, Stevenage, GB, vol. 36, No. 9, pp. 778-779, undated.
European Patent Office Communication from the corresponding European Patent Application dated Oct. 22, 2003, 4 pages.
Russian Patent Office Communication (with its English translation) from the corresponding Russian Patent Application, 10 pages, undated. Official Action in English.
Romeu, Jordi et al., "A Three Dimensional Hilbert Antenna," IEEE, pp. 550-553, 2002.
Parker et al., "Convoluted Array Elements and Reduced Size Unit Cells for Frequency-Selective Surfaces," Microwaves, Antennas & Propagation, IEEE Proceedings H, vol. 138, No. 1, pp. 19-22, Feb. 1991.
European Patent Office Communication from the corresponding European Patent Application dated Aug. 27, 2002, 4 pages.
European Patent Office Communication from the corresponding European Patent Application dated Sep. 2, 2004, 3 pages.
Dr. Carles Puente Baliarda; Fractal Antennas; Ph.D. Dissertation; May 1997; Cover page—p. 270; Electromagnetics and Photonics Engineering group, Dept. of Signal Theory and Communications, Universitat Poltécnica de Catalunya; Barcelona, Spain.
Shan-Cheng Pan and Kin-Lu Wong, "Dual-Frequency Triangular Microstrip Antenna with a Shorting Pin," IEEE Transactions on Antennas and Propagation, vol. 45, pp. 1889-1891, Dec. 1997.
Kin-Lu Wong and Jian-Yi Wu, "Single-feed Small Circularly Polarised Square Microstrip Antenna," IEEE Electronic Letters, vol. 33, pp. 1833-1834, Oct. 1997.
Xu Liang, Michael Yan Wah Chia, "Multiband Characteristics of Two Fractal Antennas," IEEE Microwave and Optical Technology Letters, vol. 33, pp. 242-245, Nov. 1999.
Sheng-Ming Deng, "A T-Strip Loaded Rectangular Microstrip Patch Antenna For Dual-Frequency Operation," 1999 IEEE AP-S International Symposium, National Radio Science Meeting, Jul. 11-16, 1999.
Wen-Shyang Chen, Chun-Kun Wu and Kin-Lu Wong, "Square-Ring Microstrip Antenna with a Cross Strip for Compact Circular Polarization Operation," IEEE Transactions on Antennas and Propagation, vol. 47, No. 10, pp. 1566-1568, Oct. 1999.
Atsuya Ando, Yasunobu Honma and Kenichi Kagoshima, "A Novel Electromagnetically Coupled Microstrip Antenna with a Rotatable Patch for Personal Handy-Phone System Units," IEEE Transactions on Antennas and Propagation, vol. 46, pp. 794-797, Jun. 1998.
Naftali Herscovici, "New Considerations in the Design of Microstrip Antennas," IEEE Transactions on Antennas and Propagation, vol. 46, No. 6, pp. 807-812, Jun. 6, 1998.
N. Chiba, T. Amano and H. Iwasaki, "Dual-Frequency Planar Antenna for Handsets," IEEE Electronic Letters, vol. 34, No. 25, pp. 2362-2363, Dec. 10, 1998.
Z. D. Liu and P. S. Hall, "Dual-Band Antenna for Hand Held Portable Telephones," IEEE Electronic Letters, vol. 32, No. 7, pp. 609-610, Mar. 28, 1996.
A. Serrano-Vaello and D. Sanchez-Hernandez, "Printed Antennas for Dual-Band GSM/DCS 1800 Mobile Handsets," IEEE Electronic Letters, vol. 34, No. 2, Jan. 22, 1998.
Zi Dong Liu, Peter S. Hall and David Wake, "Dual-Frequency Planar Inverted-F Antenna," IEEE Transactions on Antennas and Propagation, vol. 45, No. 10, pp. 1451-1458, Oct. 1997.
C. T. P. Song, P. S. Hall, H. Ghafouri-Shiraz and D. Wake, "Triple Band Planar Inverted F Antennas for Handheld Devices," IEEE Electronic Letters, vol. 36, No. 2, pp. 112-114, Jan. 20, 2000.
Alexander Moleiro, José Rosa, Rui Numes and Cuestódio Peixeiro, "Dual Band Microstrip Patch Antenna Element With Parasitic for GSM," IEEE, 2000.
T. Morioka, S. Araki and K. Hirasawa, "Slot Antenna with Parasitic Element for Dual Band Operation," IEEE Electronic Letters, vol. 24, No. 25, pp. 2093-2094, Dec. 4, 1997.
S. A. Bokhari, Jean-Francois Zurcher, Juan R. Mosig and Fred E. Gardiol, "A Small Microstrip Patch Antenna with a Convenient Tuning Option," IEEE Transactions on Antennas and Propagation, vol. 44, No. 11, pp. 1521-1528, Nov. 1996.
S. Maci and G. B. Gentili, "Dual-Frequency Patch Antennas," IEEE Antennas and Propagation Magazine, vol. 39, No. 6, pp. 13-20, Dec. 1997.
S. Sánchez-Hernández and Ian D. Robertson, "Analysis and Design of a Dual-Band Circularly Polarized Microstrip Patch Antenna," IEEE Transactions on Antennas and Propagation, vol. 43, No. 2, pp. 201-205, Feb. 1995.
E. Bahar and B. S. Lee, "Full Wave Vertically Polarized Bistatic Radar Cross Sections for Random Rough Surfaces-Comparison with Experimental and Numerical Results," IEEE Transactions on Antennas and Propagation, vol. 43, No. 2, Feb. 1995.
Corbett R. Rowell and R. D. Murch, "A Capacitively Loaded Pifa for Compact Mobile Telephone Handsets," IEEE Transactions on Antennas and Propagation, vol. 45, No. 5, pp. 837-842, May 1997.
G. J. Walker and J. R. James, "Fractal Volume Antennas," IEEE Electronic Letters, vol. 34, No. 16, pp. 1536-1537, Aug. 6, 1998.
M. Sindou, G. Ablart and C. Sourdois, "Multiband and Wideband Properties of Printed Fractal Branched Antennas," IEEE Electronic Letters, vol. 35, No. 3, pp. 181-182, Feb. 4, 1999.
H. F. Hammad, Y. M. M. Antar and A. P. Freundorfer, "Dual Band Aperture Coupled Antenna Using Spur Line," IEEE Electronic Letters, vol. 33, pp. 2088-2090, Dec. 1997.
D. H. Werner, A. Rubio Bretones and B. R. Long, Radiation Characteristics of Thin-Wire Ternary Fractal Trees, IEEE Electronic Letters, vol. 35, No. 8, pp. 609-703, Apr. 15, 1999.
J. Romeau and Y. Rahmat-Samii, "Dual Band FSS with Fractal Elements," IEEE Electronic Letters, vol. 35, pp. 702-703, Apr. 1999.
R. Breden and R. J. Langley, "Printed Fractal Antennas," National Conference on Antennas and Propagation: Mar. 30-Apr. 1, 1999, IEE Conference Publication No. 461, pp. 1-4, 1999.

C. T. P. Song, P. S. Hall, H. Ghafouri-Shiraz and D. Wake, "Sierpinski Monopole Antenna with Controlled Band Spacing and Input Impedance," Vol. 35, No. 13, pp. 1036-1037, IEEE Electronic Letters, Jun. 24, 1999.
D. H. Werner and P. L. Werner, "Frequency-Independent Features of Self-Similar Fractal Antennas," Radio Science, vol. 31, No. 7, pp. 1331-1343, Nov.-Dec. 1996.
D. H. Werner and P. L. Werner, "On the Synthesis of Fractal Radiation Patterns," Radio Science, vol. 30, No. 1, pp. 29-45, Jan.-Feb. 1995.
X. Yang, J. Chiochetti, D. Papadopoulos and L. Susman, "Fractal Antenna Elements and Arrays," Applied Microwave & Wireless, Technical Feature, pp. 34-46, no dated!
Jui-Han Lu, "Single-Feed Dual-Frequency Rectangular Microstrip Antenna," AP-S, IEEE, Jul. 2000.
Shun-Shi Zhong and Jun-Hai Cui, "Compact Dual-Frequency Microstrip Antenna," IEEE, 2000.
Duixian Liu and Thomas J. Watson, "A Dual-Band Antenna for Cellular Applications," AP-S IEEE, pp. 786-789, Jun. 1998.
Amjad A. Omar and Y. M. M. Antar, "A New Broad-Band, Dual-Frequency Coplanar Waveguide Fed Slot-Antenna," AP-S IEEE, Jul. 1999.
Jia-Yi Sze and Kin-Lu Wong, "Designs of Broadband Microstrip Antennas with Embedded Slots," AP-S, IEEE. Jul. 1999.
P. M. Bafrooei and L. Shafai, "Characteristics of Single- and Double-Layer Microstrip Square-Ring Antennas," IEEE Transactions on Antennas and Propagation, vol. 47, No. 10, pp. 1633-1639, Oct. 1999.
Jacinto Barreiros, Pedro Cameirão and Custódio Peixeiro, "Microstrip Patch Antenna for GSM 1800 Handsets," AP-S, IEEE, Jul. 1999.
Xianming Qing and Y. W. M. Chia, "A Novel Single-Feed Circular Polarized Slotted Loop Antenna," AP-S IEEE, Jul. 1999.
Jui-Han Lu, "Single-Feed Circularly Polarized Triangular Microstrip Antennas," AP-S IEEE, Jul. 1999.
Vivek Rathi, Girish Kumar and K. P. Ray, "Improved Coupling for Aperture Coupled Microstrip Antennas," IEEE Transactions on Antennas and Propagation, vol. 44, No. 8, pp. 1196-1198, Aug. 1996.
H. Iwasaki and Y. Suzuki, "Electromagnetically Coupled Circular-Patch Antenna Consisting of Multilayered Configuration," IEEE Transactions on Antennas and Propagation, vol. 44, No. 5, pp. 777-780, Jun. 1996.
M. W. Nurnberger and J. L. Volakis, "A New Planar Feed for Slot Spiral Antennas," IEEE Transactions on Antennas and Propagation, vol. 44, No. 6, pp. 130-131, Jan. 1996.
S. Maci, G.Biffi Gentili and G. Avitable, "Single-Layer Dual Frequency Patch Antenna," IEEE Electronic Letters, vol. 29,pp. 1441-1443, Aug. 1993.
C. Salvador, L. Borselli, A. Falciani and S. Maci, "Dual Frequency Planar Antenna at S and X Bands," IEEE Electronic Letters, vol. 31, pp. 1706-1707, Sep. 1995.
Kin-Lu Wong and Kai-Ping Yang, "Small Dual-Frequency Microstrip Antenna with Cross Slot," IEEE Electronic Letters, vol. 33, No. 23, pp. 1916-1917, Nov. 6, 1997.
David Sánchez-Hernández, Georgios Passiopoulos and Ian D. Robertson, "Single-Fed Dual Band Circularly Polarised Microstrip Patch Antennas," 26th EUMC, Prague, Czech Republic, pp. 273-277, Sep. 1996.
Gui-Bin Hsieh and Shan-Cheng Pan, "Dual-Frequency Slotted Triangular Microstrip Antenna With An Inset Microstrip-Line Feed," Microwave and Optical Technology Letters, vol. 27, No. 5, pp. 318-320, Dec. 5, 2000.
K. P. Ray and G. Kumar, "Multi-Frequency and Broadband Hybrid-Coupled Circular Microstrip Antennas," IEEE Electronic Letters, vol. 33, pp. 437-438, Mar. 1997.
Hooman Tehrani and Kai Chang, "A Multi-Frequency Microstrip-Fed Annular Slot Antenna," AP-S IEEE, pp. 1-4, Jul. 2000.
Jordi Romeu and Yahya Rahmat-Samii, "A Fractal Based FSS with Dual Band Characteristics, " AP-S IEEE, pp. 1734-1737, Jul. 1999.
Yuko Rikuta and Hiroyuki Arai, "A Self-Diplexing Antenna Using Stacked Patch Antennas," IEEE, 2000.
Zhi Ning Chen and Michael Y. W. Chia, "Broadband Rectangular Slotted Plate Antenna," IEEE, 2000.
Nirun Kumprasert, "Theoretical Study of Dual-Resonant Frequency and Circular Polarization of Elliptical Microstrip Antennas," IEEE, 2000.
Zhongxiang Shen, Chen Tat Sze and Choi Look Law, "A Circularly Polarized Microstrip-Fed T-Slot Antenna," School of Electrical and Electronic Engineering, Nanyang Technological University, Singapore, no dated!
Kin-Lu Wong and Tzung-Wern Chiou, "Single-Patch Broadband Circularly Polarized Microstrip Antennas," IEEE, 2000.
X. H. Yang and L. Shafai, "Multifrequency Operation Technique for Aperture Coupled Microstrip Antennas," IEEE, pp. 1198-1201, 1994.
D. Saá nchez-Hernández and Ian D. Robertson, "Triple Band Microstrip Patch Antenna Using a Spur-Line Filter and a Perturbation Segment Technique," IEEE Electronic Letters, vol. 29, pp. 1565-1566, Aug. 1993.
Frederic Croq and David M. Pozar, "Multifrequency Operation of Microstrip Antenna Using Aperture Coupled Parallel Resonators," vol. 40, No. 11, pp. 1367-1374, Nov. 1992.
Jui-Han Lu, Chia-Luan Tang and Kin-Lu Wong, "Single-Feed Slotted Equilateral-Triangular Microstrip Antenna for Ciruclar Polarization," vol. 47, No. 7, pp. 1174-1178, Jul. 1999.
Kin-Lu Wong and Wen-Hsiu Hsu, "Broadband Triangular Microstrip Antenna with U-Shaped Slot," IEEE Electronic Letters, vol. 33, pp. 2085-2087, Dec. 1997.
J. F. Zürcher, D. Marty, O. Staub and A. Skrivervik, "A Compact Dual-Port, Dual-Frequency Ssfip/Pifa Antenna with High Decoupling," Microwave and Optical Technology Letters, vol. 22, No. 6, pp. 373-378, Sep. 20, 1999.
G. P. Srivastava, S. Bhattacharya and S. K. Padhi, "Dual Band Tunable Microstrip Patch Antenna," IEEE Electronic Letters, vol. 35, pp. 1397-1399, Aug. 1999.
S. D. Targonski and D. M. Pozar, "Dual-Band Dual Polarised Printed Antenna Element," IEEE Electronic Letters, vol. 34, pp. 2193-2194, Nov. 1998.
Y. X. Guo, K. M. Luk and K. F. Lee, "Dual-Band Slot-Loaded Short-Circuited Patch Antenna," IEEE Electronic Letters, vol. 36, pp. 289-291, Feb. 2000.
J. Fuhl, P. Nowak and E. Bonek, "Improved Internal Antenna for Hand-Held Terminals," IEEE Electronic Letters, vol. 30, pp. 1816-1818, Oct. 1994.
R. B. Waterhouse, "Printed Antenna Suitable for Mobile Communications Handsets" IEEE Electronic Letters, vol. 33, No. 22, pp. 1831-1832, Oct. 23, 1997.
J. Ollikainen, M. Fischer and P. Vainikainen, "Thin Dual-Resonant Stacked Shorted Patch Antenna for Mobile Communications," IEEE Electronic Letters, vol. 35, No. 6, pp. 437-438, Mar. 18, 1999.
M. Rahman, M. A. Stuchly and M. Okoniewski, "Dual-Band Strip-Sleeve Monopole for Handheld Telephones," IEEE Microwave and Optical Technology Letters, vol. 21, No. 2, pp. 79-82, Apr. 1999.
Kyu-Sung Kim, Taewoo Kim and Jaehoon Choi, "Dual-Frequency Aperture-Coupled Square Patch Antenna with Double Notches," IEEE Microwave and Optical Technology Letters, vol. 24, No. 6, pp. 370-374, Mar. 20, 2000.
Jui-Han Lu, "Slot-Loaded Rectangular Microstrip Antenna for Dual-Frequency Operation," IEEE Microwave and Optical Technology Letters, vol. 24, No. 4, pp. 234-237, Feb. 2000.
C. T. P. Song, P. S. Hall, H. Ghafouri-Shiraz and D. Wake, " Fractal Stacked Monopole with Very Wide Bandwidth," IEEE Electronic Letters, vol. 35, No. 12, pp. 945-946, Jun. 1999.
Kin-Lu Wong and Kai-Ping Yang, "Modified Planar Inverted F Antenna." IEE Electronics Letters, vol. 34, No. 1, pp. 7-8, Jan. 1998.
S. K. Palit, A. Hamadi and D. Tan, "Design of a Wideband Dual-Frequency Notched Microstrip Antenna," AP-S IEEE, pp. 2351-2354, Jun. 1998.
T. Williams, M. Rahman and M. A. Stuchly. "Dual-Band Meander Antenna for Wireless Telephones," IEEE Microwave and Optical Technology Letters, vol. 24, No. 2, pp. 81-85, Jan. 20, 2000.
Nathan Cohen, "Fractal Antennas, Part 1," Communications Quarterly: The Journal of Communications Technology, pp. 7-22, Summer 1995.

Nathan Cohen, "Fractal and Shaped Dipoles," Communications Quarterly: The Journal of Communications Technology, pp. 25-36, Spring 1995.
Nathan Cohen, "Fractal Antennas: Part 2—A Discussion of Relevant, But Disparate Qualities," Communications Quarterly: The Journal of Communications Technology, pp. 53-66, Summer 1996.
C. Puente and R. Pous, "Deseño Fractal de Agrupaciones de Antenas," IX Simposium Nacional URSI, vol. I, pp. 227-231, Las Palmas, Sep. 1994. English Abstract.
John P. Gianvittorio and Yahya Rahmat-Samii, "Fractal Element Antennas: A Compilation of Configurations with Novel Characteristics," IEEE, 4 pages, 2000.
Jacob George, C. K. Aanandan, P. Mohanan and K. G. Nair, "Analysis of a New Compact Microstrip Antenna," IEEE Transactions on Antennas and Propagation, vol. 46, No. 11, pp. 1712-1717, Nov. 1998.
Jungmin Chang and Sangseol Lee, "Hybrid Fractal Cross Antenna," IEEE Microwave and Optical Technology Letters, vol. 25, No. 6, pp. 429-435, Jun. 20, 2000.
Jaume Anguera, Carles Puente, Carmen Borja and Raquel Montero. "Antenna Microstrip Miniatura y de Alta Directividad basada en el fractal de Sierpinski," Proceedings of the XIV National Symposium of the Scientific International Union of Radio, URSI '01, Madrid, Spain, Sep. 2001. English Abstract.
Jaume Anguera, et al., "Diseño de Antenas Impresas de Banda Ancha Alimentadas Mediante Acoplo Capacitivo." Proceedings of the XIII National Symposium of the Scientific International Union of Radio, URSI '00, Zaragoza, Spain, Sep. 2000. English Abstract.
J. Anguera, G. Font, C. Puente, C. Borja and J. Soler, "Multifrequency Microstrip Patch Antenna Using Multiple Stacked Elements," IEEE Microwave and Wireless Components Letters, vol. 13, No. 3, pp. 123-124, Mar. 2003.
C. Puente, M. Navarro, J. Romeu and R. Pous, "Variations on the Fractal Sierpinski Antenna Flare Angle," IEEE Antennas & Propagation, URSI Symposium Meeting, Atlanta, Jun. 1998.
J. Soler and J. Romeu, "Antenas de Sierpinski de Modulo-ρ," Proceedings of the XIII Nacional Symposium of the Scientific International Union of Radio, URSI 2000, Zaragoza, Spain, Sep. 2000. English Abstract.
C. Borja and C. Puente, "Multiband Sierpinski Fractal Patch Antenna," IEEE Antennas and Propagation Society International Symposium 2000, Salt Lake City, Jul. 2000.
J. Soler and C. Puente, "Analysis of the Sierpinski Fractal Multiband Antenna Using the Multiperiodic Traveling Wave V Model," 24th ESTEC Antenna Workshop on Innovative Periodic Antennas, ESTEC, Noordwijk, pp. 53-57, May-Jun. 2000.
J. Soler, J. Romeu and C. Puente, "Mod-ρ Sierpinski Fractal Multiband Antenna," AP2000 Millennium Conference on Antennas and Propagation, Davos, Apr. 9-14, 2000.
C. Puente, J. Anguera, J. Romeu, C. Borja, M. Navarro and J. Soler, "Fractal-Shaped Antennas and their Application to GSM 900/1800," AP2000 Millenium Conference on Antennas and Propagation, Davos, Apr. 2000.
J. Anguera, C. Puente, J. Romeu and C. Borja, "An Optimum Method to Design Probe-Fed Single-Layer Single-Path Wideband Microstrip Antenna," AP2000 Millenium Conference on Antennas and Propagation, Davos, Apr. 2000.
C. Borja, J. Romeu, J. Anguera and C. Puente, "Fractal Multiband Patch Antenna," AP2000 Millenium Conference on Antennas and Propagation. Davos, Apr. 2000.
C. Puente, C. Borja, M. Navarro and J. Romeu, "An Iterative Model for Fractal Antennas, Application to the Sierpinski Gasket Antenna," IEEE Transactions on Antennas and Propagation, Sep. 2000.
C. Borja and J. Romeu, "Parche de Sierpinski Perturbado," XV Simposium Nacional URSI Zaragoza, Sep. 2000. English Abstract.
J. Soler, D. Garcia, C. Puente and J. Anguera, "Novel Combined Mod-P Structures, A Complete Set of Multiband Antennas Inspired on Fractal Geometries," AP-S, 2003.
J. Soler, C. Puente and J. Anguera, "Results on a New Extended Analytic Model to Understand the Radiation Performance of Mod-P Sierpinski Fractal Multiband Antennas," AP-S, 2003.
C. Borja, C. Puente, A. Medina, J. Romeu and R. Pous, "Traslación de la Propledad de Autosemejanza de los Fractales al Comportamiento Electromagnético de Parches con Geometria Fractal," XIII Simposium Nacional URSI, vol. I, pp. 437-439, Pamplona, Sep. 1998. English Abstract.
C. Borja, C. Puente, J. Anguera, J. Romeu and R. Pous, "Estudio experimental del parche de Sierpinski," XIV Simposium Nacional URSI, pp. 379-380, Santiago de Compostela, Sep. 1999. English Abstract.
C. Puente, M. Navarro, J. Romeu and R. Pous, "Efecto de la Variación del Vérticle de Alimentación en la Antena Fractal de Sierpinski," XII Simposium Nacional URSI. Bilbao, Sep. 1997. English Abstract.
C. Borja, C. Puente, A. Medina, J. Romeu, and R. Pous, "Modelo Sencillo para el Estudio de los Parametros de Entrada de una Antena Fractal de Sierpinski," XII Simposium Nacional URSI,vol. I, pp. 363-371, Bilbao, Sep. 1997. English Abstract.
M. Navarro, C. Puente, R. Bartolomé, A. Medina, J. Romeu and R. Pous, "Modification de la Antena de Sierpinski para el Ajuste de las Bandas Operativas," XII Simposium Nacional URSI, vol. I, pp. 371-373, Bilbao, Sep. 1997.
M. Navarro, et al., "Comprobación del Comportamiento Autosimilar de la Distribución de Corrientes sobre la Superficie de la Antena Fractal de Sierpinski Mediante Termograflas de Infrarojos," XII Simposium Nacional URSI, vol. I, pp. 369-371, Sep. 1998. English Abstract.
J. Soler, C. Puente and A. Munduate, "Novel Broadband and Multiband Solutions for Planar Monopole Antenas," IEEE Antennas and Propagation Society International Symposium 2002, San Antonio, Jun. 2002.
Roscoe, Tunable dipole antennas, Antennas and propagation society international symposium 1993.
Sanad, Compact internal multiband microstrip antennas for portable GPS, PCS, cellular and satellitle phones, Microwave Journal, 1999.
Sanad, An internal integrated microstrip antenna for PCS/Cellular telephones and other hand-held portable communication equipment, 1998.
Sanchez, D., A survey of broadband microstrip Microwave Journal, Sep. 1996.
Gianvittorio, Fractal antenna research at UCLA, UCLA Antenna Lab, Nov. 1999.
Rowell et al. A Compact PIFA Suitable for Dual-Frequency 900/1800-MHz Operation, IEEE Transactions on Antennas and Propagation, 1998, vol. 46, No. 4.
Lu et al. Slot-loaded, meandered rectangular microstrip antenna with compact dualfrequency operation. Electronic Letters, May 1998, vol. 34, No. 11.
Wu et al. Slot-coupled meandered microstrip antenna for compact dual-frequency operation, Electronic Letters, 1998, vol. 34, No. 11.
Yang et al. Compact dual-frequency operation of rectangular microstrip antennas, IEEE International Symposium 1999. Antennas and Propagation Society, 1999.
Pan, Single-feed dual-frequency microstrip antenna with two patches, IEEE Antennas and Propagation Society International Symposium, 1999.
Wu et al. Dual-frequency microstrip reflectary, AP-S. Digest. Antennas and Propagation Society International Symposium, 1995.
Cho, Modified slot-loaded triple-band microstrip patch antenna, No Date Provided.
Lu, Slot-loaded rectangular microstrip antenna for fual-frequency operation, Microwave and Optical Technology Letters, Feb. 2000, vol. 24, No. 4.
Hart et al. Fractal element antennas, ital Image Computing and Applications, 1997.
Hoffmeister, M., The dual-frequency inverted f-monopole antenna for mobile communications, 1999.
Kronberger, R., Multiband planar inverted-F car antenna for mobile phone and GPS, IEEE, 1999.
Breden, R., Multiband printed antenna for vehicles, 1999.
Viratelle, D. Dual band PIFA antenna, 1999.

Nokia Movile Phones, "User's guide", 1999, 82 pag., Nokia Mobile Phones, Finland.

Navarro Rodero, Monica, "Diverse Modifications Applied to the Sierpinski Antenna, A Multi-Band Fractal Antenna" (Final Degree Project), Oct.-1997, Universitat Politecnica de Catalunya, Barcelona, Spain.

Gobien, Andrew T., "Investigation of Low Profile Antenna Designs for Use in Hand-Held Radios", Aug. 1, 1997, Faculty of the Virginia Polytechnic Institute and State University, Blacksburg, Virginia, U.S.A.

* cited by examiner 6.1

6.2

6.3

6.4

6.5

6.6

6.7

6.8

6.9

7.1

7.2

7.3

7.4

7.5

7.6

7.7

7.8

10.1

10.2

10.3

10.4

12.1

12.2

*f=1905 MHz*

13.1

13.2

13.3

*f=3500 MHz*

13.4

13.5

13.6

MULTILEVEL ANTENNAE

CROSS REFERENCE TO RELATED APPLICATIONS

This application is a Continuation application of U.S. Ser. No. 11/102,390 filed on Apr. 8, 2005, entitled: Multilevel Antennae now U.S. Pat. No. 7,123,208; which is a Continuation application of U.S. Ser. No. 10/963,080, filed on Oct. 12, 2004, entitled: Multilevel Antennae now U.S. Pat. No. 7,015,868; which is a Continuation application of U.S. Ser. No. 10/102,568, filed on Mar. 18, 2002 now ABN.

OBJECT OF THE INVENTION

The present invention relates to antennae formed by sets of similar geometrical elements (polygons, polyhedrons electro magnetically coupled and grouped such that in the antenna structure may be distinguished each of the basic elements which form it.

More specifically, it relates to a specific geometrical design of said antennae by which two main advantages are provided: the antenna may operate simultaneously in several frequencies and/or its size can be substantially reduced.

The scope of application of the present invention is mainly within the field of telecommunications, and more specifically in the field of radio-communication.

BACKGROUND AND SUMMARY OF THE INVENTION

Antennae were first developed towards the end of the past century, when James C. Maxwell in 1864 postulated the fundamental laws of electromagnetism. Heinrich Hertz may be attributed in 1886 with the invention of the first antenna by which transmission in air of electromagnetic waves was demonstrated. In the mid forties were shown the fundamental restrictions of antennae as regards the reduction of their size relative to wavelength, and at the start of the sixties the first frequency-independent antennae appeared. At that time helixes, spirals, logoperiodic groupings, cones and structures defined solely by angles were proposed for construction of wide band antennae.

In 1995 were introduced the fractal or multifractal type antennae (Patent no. 9501019), which due to their geometry presented a multifrequency behavior and in certain cases a small size. Later were introduced multitriangular antennae (Patent no. 9800954) which operated simultaneously in bands GSM 900 and GSM 1800.

The antennae described in the present patent have their origin in fractal and multitriangular type antennae, but solve several problems of a practical nature which limit the behavior of said antennae and reduce their applicability in real environments.

From a scientific standpoint strictly fractal antennae are impossible, as fractal objects are a mathematical abstraction which include an infinite number of elements. It is possible to generate antennae with a form based on said fractal objects, incorporating a finite number of iterations. The performance of such antennae is limited to the specific geometry of each one. For example, the position of the bands and their relative spacing is related to fractal geometry and it is not always possible, viable or economic to design the antennae maintaining its fractal appearance and at the same time placing the bands at the correct area of the radioelectric spectrum. To begin, truncation implies a clear example of the limitations brought about by using a real fractal type antenna which attempts to approximate the theoretical behavior of an ideal fractal antenna. Said effect breaks the behavior of the ideal fractal structure in the lower band, displacing it from its theoretical position relative to the other bands and in short requiring a too large size for the antenna which hinders practical applications.

In addition to such practical problems, it is not always possible to alter the fractal structure to present the level of impedance of radiation diagram which is suited to the requirements of each application. Due to these reasons, it is often necessary to leave the fractal geometry and resort to other types of geometries which offer a greater flexibility as regards the position of frequency bands of the antennae, adaptation levels and impedances, polarization and radiation diagrams.

Multitriangular structures (Patent no. 9800954) were an example of non-fractal structures with a geometry designed such that the antennae could be used in base stations of GSM and DCS cellular telephony. Antennae described in said patent consisted of three triangles joined only at their vertices, of a size adequate for use in bands 890 MHz-960 MHz and 1710 MHz-1880 MHz. This was a specific solution for a specific environment which did not provide the flexibility and versatility required to deal with other antennae designs for other environments.

Multilevel antennae solve the operational limitations of fractal and multitriangular antennae. Their geometry is much more flexible, rich and varied, allowing operation of the antenna from two to many more bands, as well as providing a greater versatility as regards diagrams, band positions and impedance levels, to name a few examples. Although they are not fractal, multilevel antennae are characterised in that they comprise a number of elements which may be distinguished in the overall structure. Precisely because they clearly show several levels of detail (that of the overall structure and that of the individual elements which make it up), antennae provide a multiband behavior and/or a small size. The origin of their name also lies in said property.

The present invention consists of an antenna whose radiating element is characterised by its geometrical shape, which basically comprises several polygons or polyhedrons of the same type. That is, it comprises for example triangles, squares, pentagons, hexagons or even circles and ellipses as a limiting case of a polygon with a large number of sides, as well as tetrahedra, hexahedra, prisms, dodecahedra, etc. coupled to each other electrically (either through at least one point of contact o through a small separation providing a capacitive coupling) and grouped in structures of a higher level such that in the body of the antenna can be identified the polygonal or polyhedral elements which it comprises. In turn, structures generated in this manner can be grouped in higher order structures in a manner similar to the basic elements, and so on until reaching as many levels as the antenna designer desires.

Its designation as multilevel antenna is precisely due to the fact that in the body of the antenna can be identified at least two levels of detail: that of the overall structure and that of the majority of the elements (polygons or polyhedrons) which make it up. This is achieved by ensuring that the area of contact or intersection (if it exists) between the majority of the elements forming the antenna is only a fraction of the perimeter or surrounding area of said polygons or polyhedrons.

A particular property of multilevel antennae is that their radioelectric behavior can be similar in several frequency bands. Antenna input parameters (impedance and radiation diagram) remain similar for several frequency bands (that is, the antenna has the same level of adaptation or standing wave relationship in each different band), and often the antenna presents almost identical radiation diagrams at different frequencies. This is due precisely to the multilevel structure of the antenna, that is, to the fact that it remains possible to identify in the antenna the majority of basic elements (same type polygons or polyhedrons) which make it up. The number of frequency bands is proportional to the number of scales or sizes of the polygonal elements or similar sets in which they are grouped contained in the geometry of the main radiating element.

In addition to their multiband behavior, multilevel structure antennae usually have a smaller than usual size as compared to other antennae of a simpler structure. (Such as those consisting of a single polygon or polyhedron). This is because the path followed by the electric current on the multilevel structure is longer and more winding than in a simple geometry, due to the empty spaces between the various polygon or polyhedron elements. Said empty spaces force a 'given path' for the current (which must circumvent said spaces) which travels a greater distance and therefore resonates at a lower frequency. Additionally, its edge-rich and discontinuity-rich structure simplifies the radiation process, relatively increasing the radiation resistance of the antenna and reducing the quality factor Q, i.e. increasing its bandwidth.

Thus, the main characteristic of multilevel antennae are the following:

A multilevel geometry comprising polygon or polyhedron of the same class, electromagnetically coupled and grouped to form a larger structure. In multilevel geometry most of these elements are clearly visible as their area of contact, intersection or interconnection (if these exist) with other elements is always less than 50% of their perimeter.

The radioelectric behavior resulting from the geometry: multilevel antennae can present a multiband behavior (identical or similar for several frequency bands) and/or operate at a reduced frequency, which allows to reduce their size.

In specialized literature it is already possible to find descriptions of certain antennae designs which allow to cover a few bands. However, in these designs the multiband behavior is achieved by grouping several single band antennae or by incorporating reactive elements in the antennae (concentrated elements as inductors or capacitors or their integrated versions such as posts or notches) which force the apparition of new resonance frequencies. Multilevel antennae on the contrary base their behavior on their particular geometry, offering a greater flexibility to the antenna designer as to the number of bands (proportional to the number of levels of detail), position, relative spacing and width, and thereby offer better and more varied characteristics for the final product.

A multilevel structure can be used in any known antenna configuration. As a nonlimiting example can be cited: dipoles, monopoles, patch or microstrip antennae, coplanar antennae, reflector antennae, wound antennae or even antenna arrays. Manufacturing techniques are also not characteristic of multilevel antennae as the best suited technique may be used for each structure or application. For example: printing on dielectric substrate by photolithography (printed circuit technique); dieing on metal plate, repulsion on dielectric, etc.

Publication WO 97/06578 discloses a fractal antenna, which has nothing to do with a multilevel antenna being both geometries essentially different.

BRIEF DESCRIPTION OF THE DRAWINGS

Further characteristics and advantages of the invention will become apparent in view of the detailed description which follows of a preferred embodiment of the invention given for purposes of illustration only and in no way meant as a definition of the limits of the invention, made with reference to the accompanying drawings, in which.

DESCRIPTION OF THE PREFERRED EMBODIMENT OF THE INVENTION

In the detailed description which follows f a preferred embodiment of the present invention permanent reference is made to the figures of the drawings, where the same numerals refer to the identical or similar parts.

The present invention relates to an antenna which includes at least one construction element in a multilevel structure form. A multilevel structure is characterized in that it is formed by gathering several polygon or polyhedron of the same type (for example triangles, parallelepipeds, pentagons, hexagons, etc., even circles or ellipses as special limiting cases of a polygon with a large number of sides, as well as tetrahedra, hexahedra, prisms, dodecahedra, etc. coupled to each other electromagnetically, whether by proximity or by direct contact between elements. A multilevel structure or figure is distinguished from another conventional figure precisely by the interconnection (if it exists) between its component elements (the polygon or polyhedron). In a multilevel structure at least 75% of its component elements have more than 50% of their perimeter (for polygons) not in contact with any of the other elements of the structure. Thus, in a multilevel structure it is easy to identify geometrically and individually distinguish most of its basic component elements, presenting at least two levels of detail: that of the overall structure and that of the polygon or polyhedron elements which form it. Its name is precisely due to this characteristic and from the fact that the polygon or polyhedron can be included in a great variety of sizes. Additionally, several multilevel structures may be grouped and coupled electromagnetically to each other to form higher level structures. In a multilevel structure all the component elements are polygons with the same number of sides or polyhedron with the same number of faces. Naturally, this property is broken when several multilevel structures of different natures are grouped and electromagnetically coupled to form meta-structures of a higher level.

In this manner, in FIGS. 1 to 7 are shown a few specific examples of multilevel structures.

Figure 1:
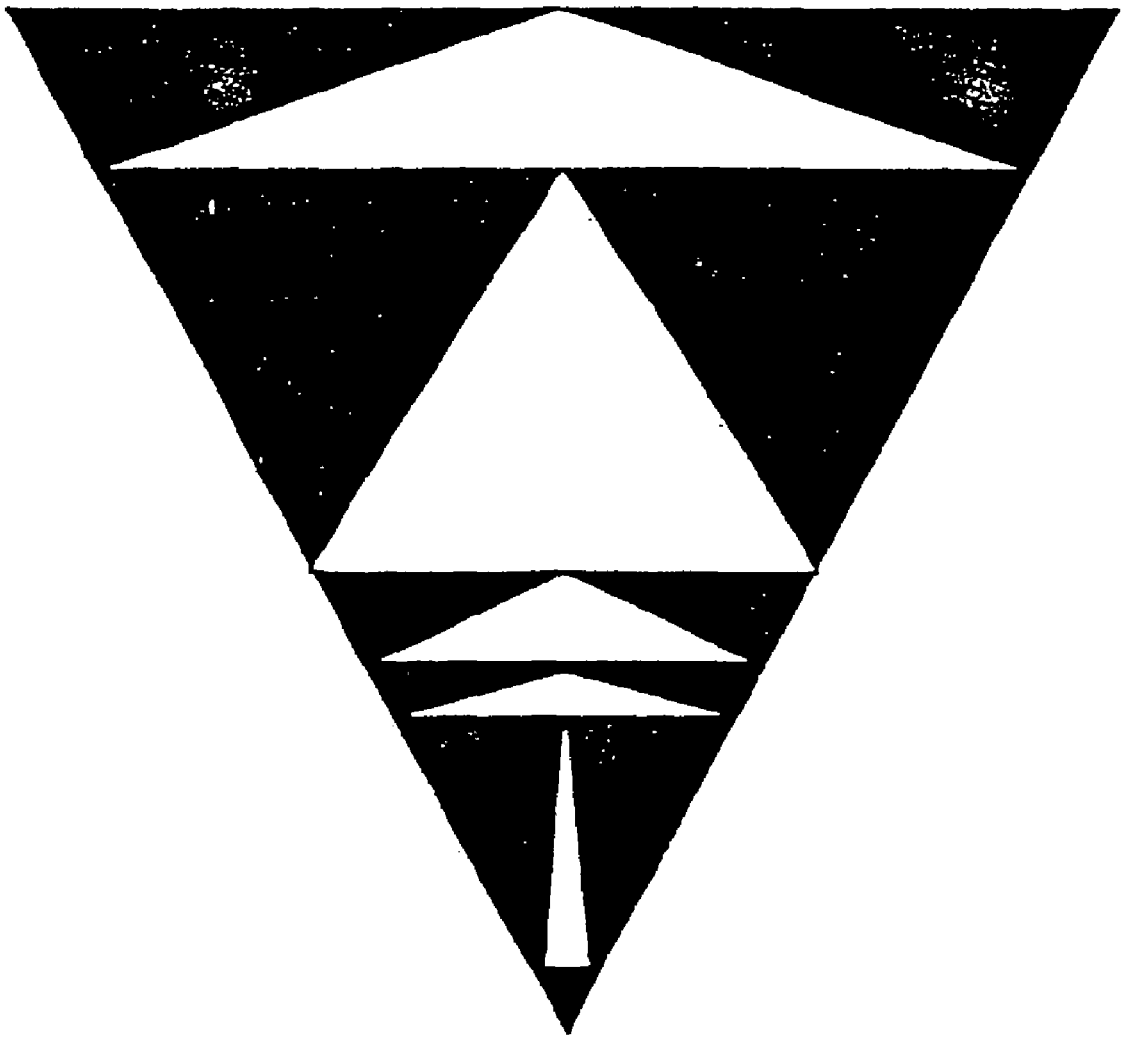
FIG. 1 shows a specific example of a multilevel element comprising only triangular polygons.

FIG. 1 shows a multilevel element exclusively consisting of triangles of various sizes and shapes. Note that in this particular case each and every one of the elements (triangles, in black) can be distinguished, as the triangles only overlap in a small area of their perimeter, in this case at their vertices.

Figure 2:
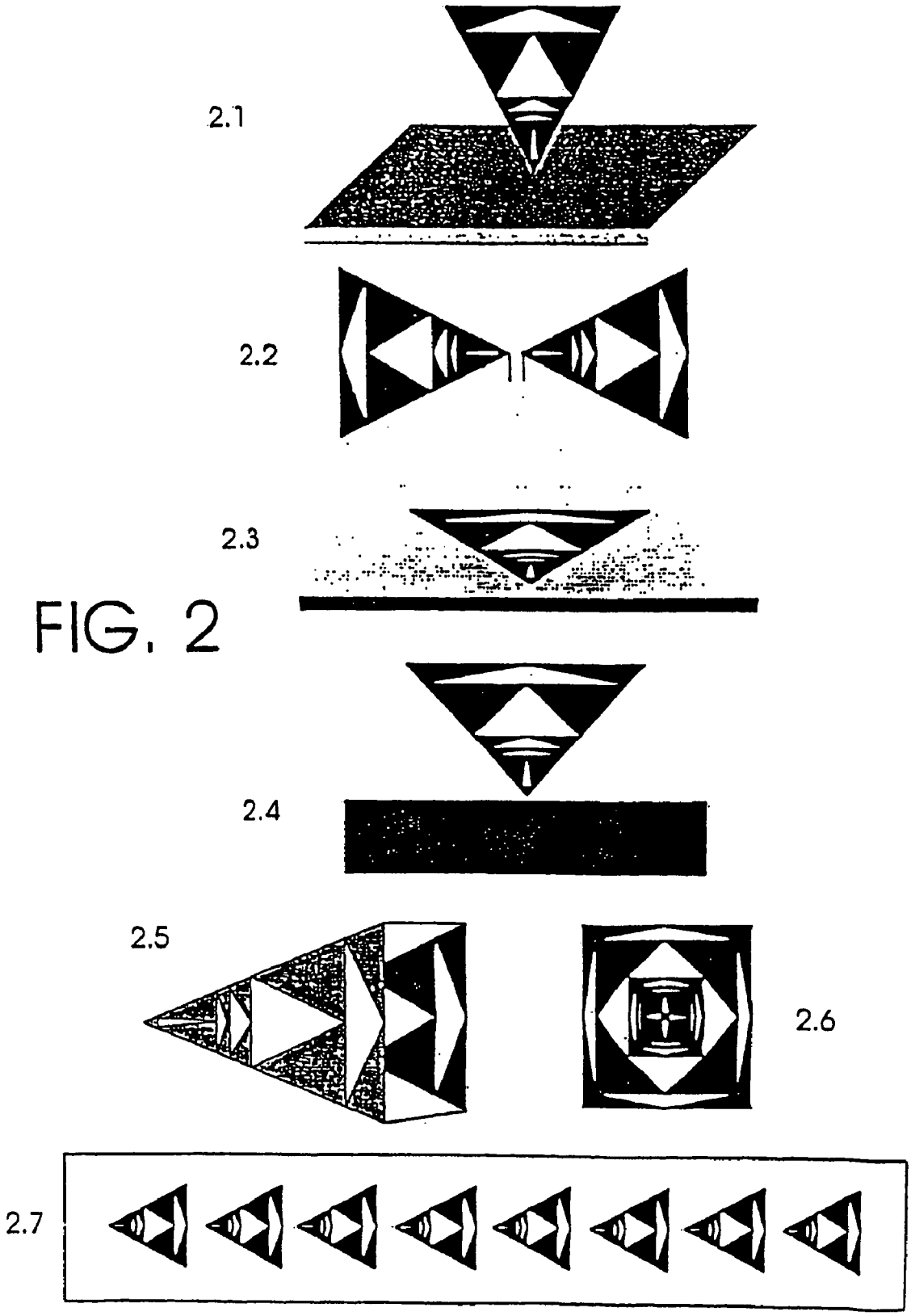
FIG. 2 shows examples of assemblies of multilevel antennae in several configurations: monopole (2.1), dipole (2.2), patch (2.3), coplanar antennae (2.4), horn (2.5-2.6) and array (2.7).

FIG. 2 shows examples of assemblies of multilevel antennae in various configurations: monopole (21), dipole (22), patch (23), coplanar antennae (24), coil in a side view (25) and front view (26) and array (27). With this it should be remarked that regardless of its configuration the multilevel antenna is different from other antennae in the geometry of its characteristic radiant element.

Figure 3:
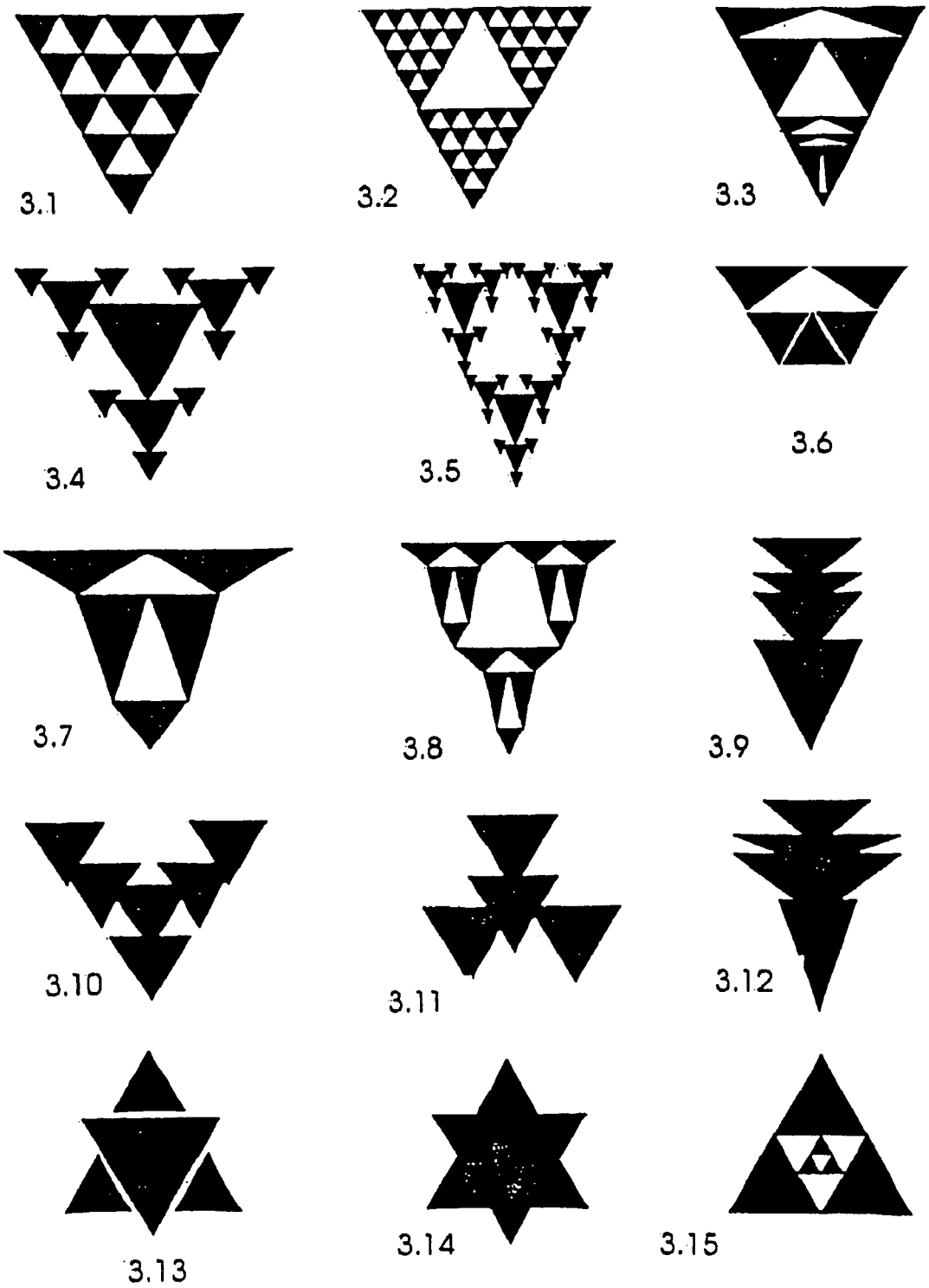
FIG. 3 shows examples of multilevel structures based on triangles.

FIG. 3 shows further examples of multilevel structures (3.1-3.15) with a triangular origin, all comprised of triangles. Note that case (3.14) is an evolution of case (3.13); despite the contact between the 4 triangles, 75% of the elements (three triangles, except the central one) have more than 50% of the perimeter free.

Figure 4:
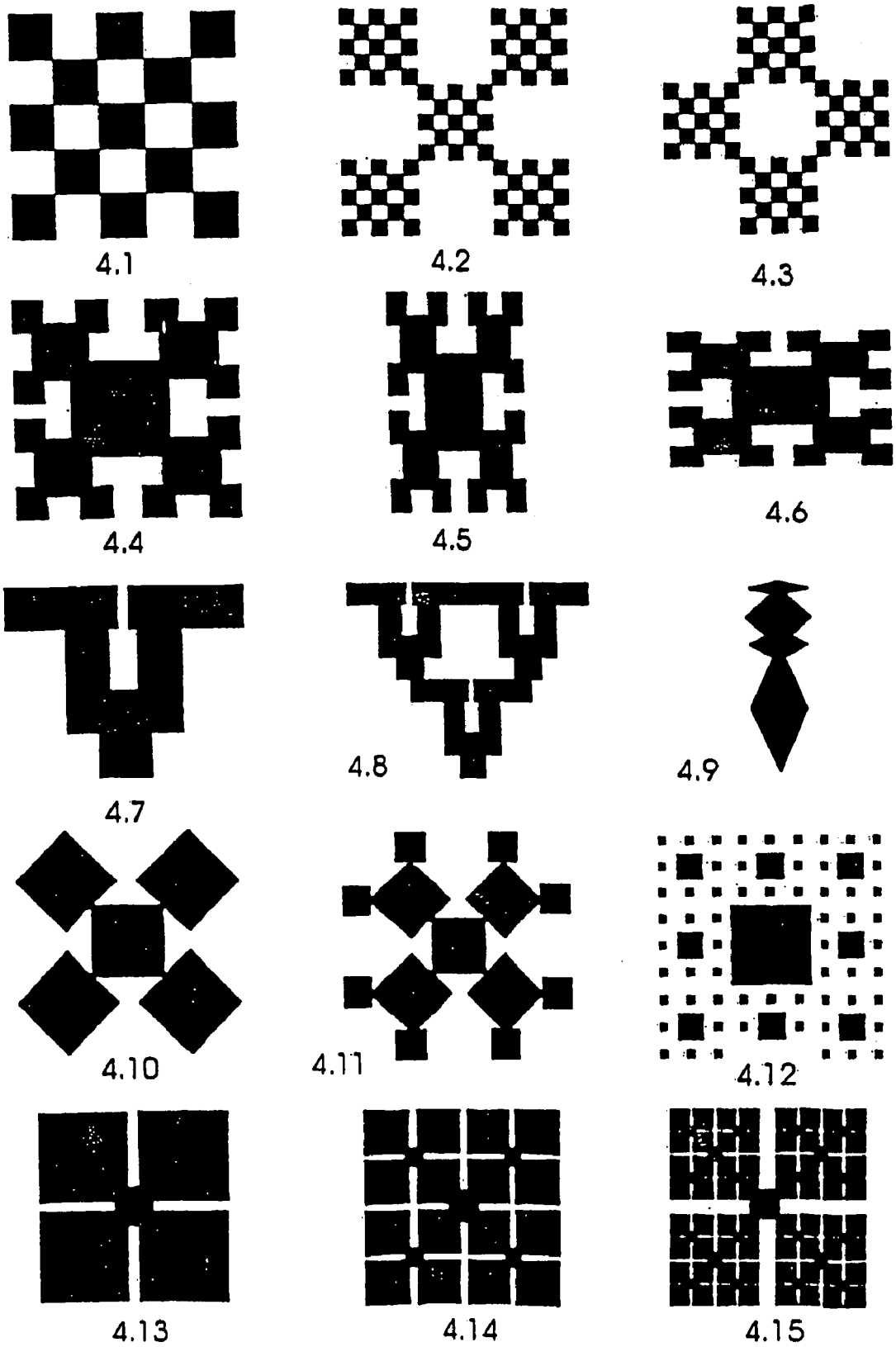
FIG. 4 shows examples of multilevel structures based on parallelepipeds.

FIG. 4 describes multilevel structures (4.1-4.14) formed by parallelepipeds (squares, rectangles, rhombi . . . ). Note that the component elements are always individually identifiable (at least most of them are). In case (4.12), specifically, said elements have 100% of their perimeter free, without there being any physical connection between them (coupling is achieved by proximity due to the mutual capacitance between elements).

Figure 5:
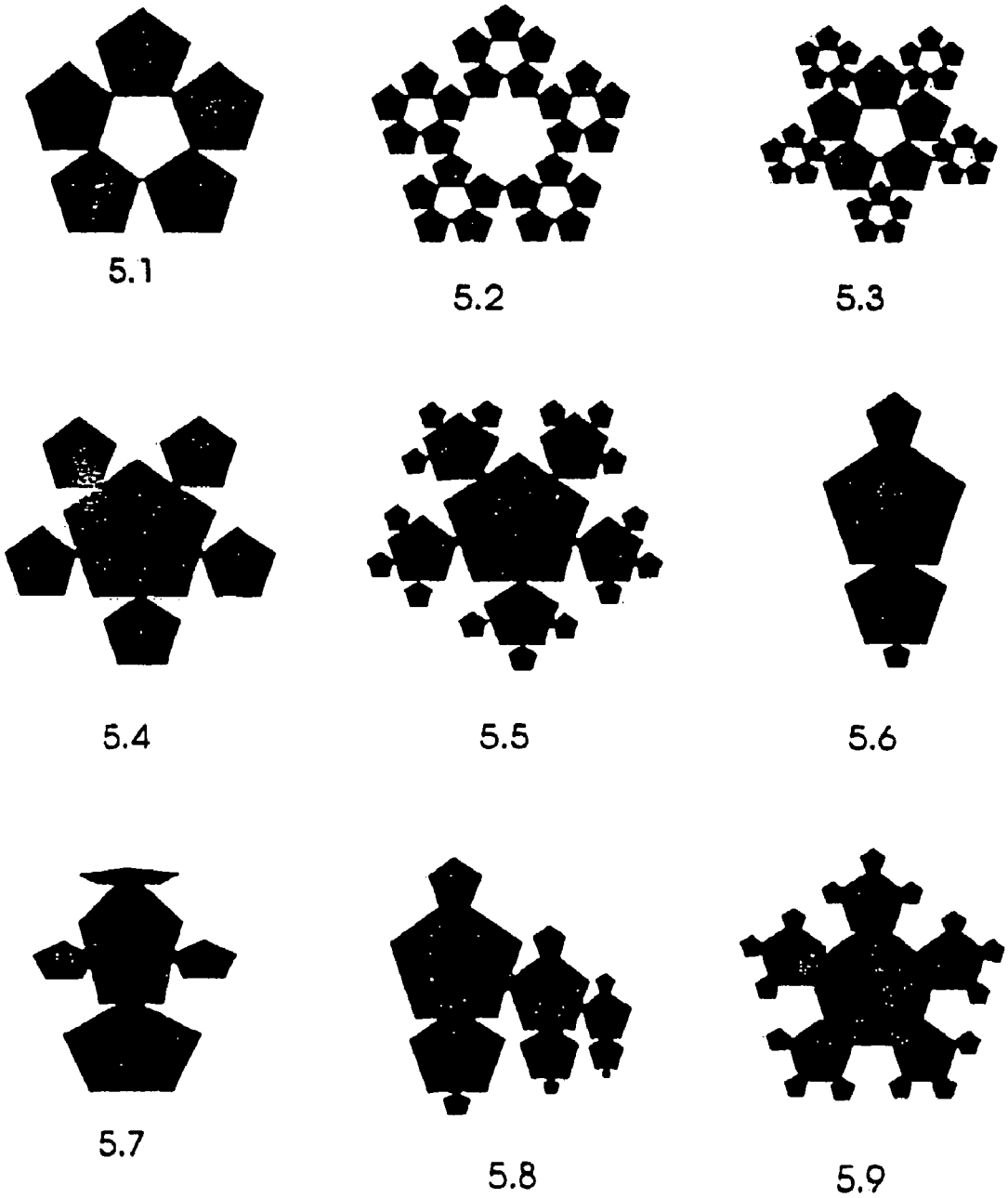
FIG. 5 examples of multilevel structures based on pentagons.
Figure 6:
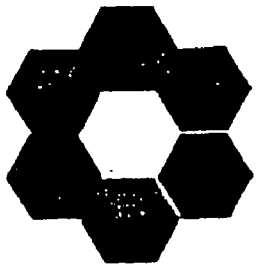
FIG. 6 shows of multilevel structures based on hexagons.
Figure 6:
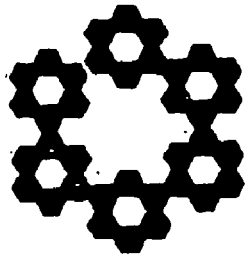
Figure 6:
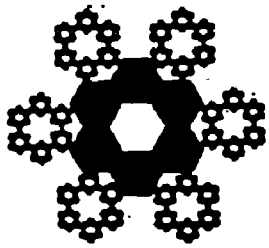
Figure 6:
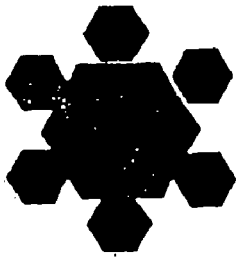
Figure 6:
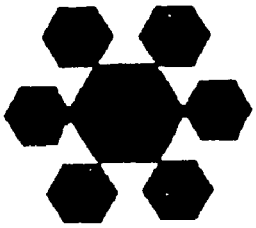
Figure 6:
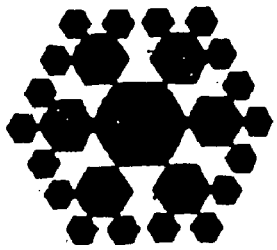
Figure 6:
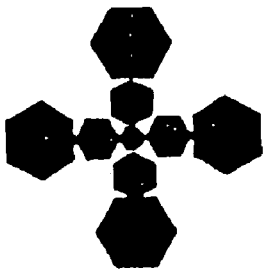
Figure 6:
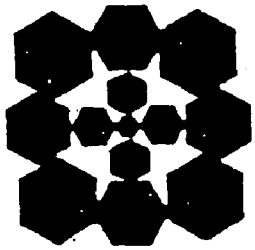
Figure 6:
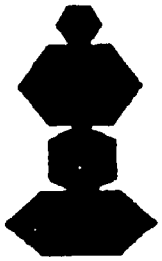
Figure 7:
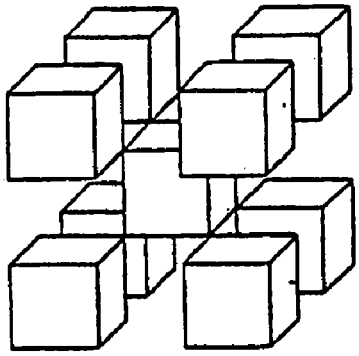
FIG. 7 shows of multilevel structures based on polyhedrons.
Figure 7:
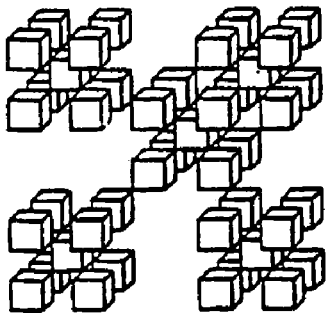
Figure 7:
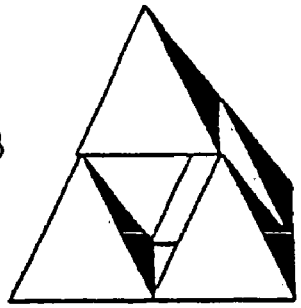
Figure 7:
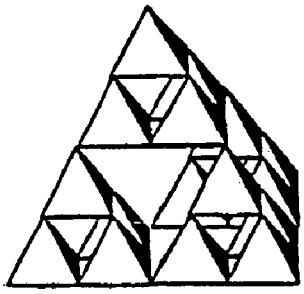
Figure 7:
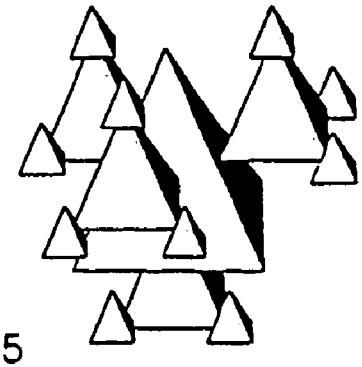
Figure 7:
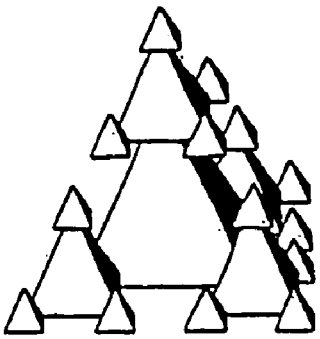
Figure 7:
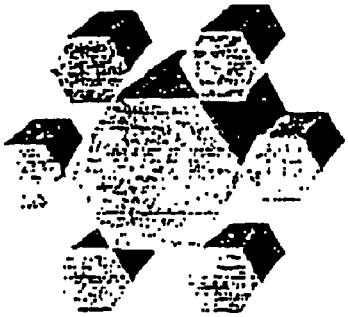
Figure 7:
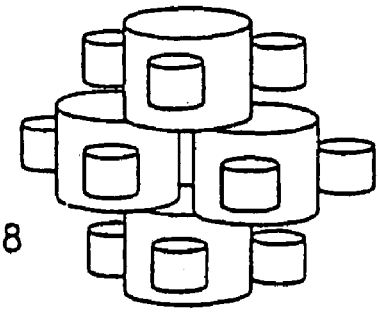

FIGS. 5, 6 and 7 show non limiting examples of other multilevel structures based on pentagons, hexagons and polyhedron respectively.

It should be remarked that the difference between multilevel antennae and other existing antennae lies in the particular geometry, not in their configuration as an antenna or in the materials used for construction. Thus, the multilevel structure may be used with any known antenna configuration, such as for example and in a non limiting manner: dipoles, monopoles, patch or microstrip antennae, coplanar antennae, reflector antennae, wound antennae or even in arrays. In general, the multilevel structure forms part of the radiative element characteristic of said configurations, such as the arm, the mass plane or both in a monopole, an arm or both in a dipole, the patch or printed element in a microstrip, patch or coplanar antenna; the reflector for an reflector antenna, or the conical section or even antenna walls in a horn type antenna. It is even possible to use a spiral type antenna configuration in which the geometry of the loop or loops is the outer perimeter of a multilevel structure. In all, the difference between a multilevel antenna and a conventional one lies in the geometry of the radiative element or one of its components, and not in its specific configuration.

As regards construction materials and technology, the implementation of multilevel antennae is not limited to any of these in particular and any of the existing or future techniques may be employed as considered best suited for each application, as the essence of the invention is found in the geometry used in the multilevel structure and not in the specific configuration. Thus, the multilevel structure may for example be formed by sheets, parts of conducting or superconducting material, by printing in dielectric substrates (rigid or flexible) with a metallic coating as with printed circuits, by imbrications of several dielectric materials which form the multilevel structure, etc. always depending on the specific requirements of each case and application. Once the multilevel structure is formed the implementation of the antenna depends on the chosen configuration (monopole, dipole, patch, horn, reflector . . . ). For monopole, spiral, dipole and patch antennae the multisimilar structure is implemented on a metal support (a simple procedure involves applying a photolithography process to a virgin printed circuit dielectric plate) and the structure is mounted on a standard microwave connector, which for the monopole or patch cases is in turn connected to a mass plane (typically a metal plate or case) as for any conventional antenna. For the dipole case two identical multilevel structures form the two arms of the antenna; in an opening antenna the multilevel geometry may be part of the metal wall of a horn or its cross section, and finally for a reflector the multisimilar element or a set of these may form or cover the reflector.

The most relevant properties of the multilevel antennae are mainly due to their geometry and are as follows: the possibility of simultaneous operation in several frequency bands in a similar manner (similar impedance and radiation diagrams) and the possibility of reducing their size compared to other conventional antennae based exclusively on a single polygon or polyhedron. Such properties are particularly relevant in the field of communication systems. Simultaneous operation in several freq bands allows a single multilevel antenna to integrate several communication systems, instead of assigning an antenna for each system or service as is conventional. Size reduction is particularly useful when the antenna must be concealed due to its visual impact in the urban or rural landscape, or to its unaesthetic or unaerodynamic effect when incorporated on a vehicle or a portable telecommunication device.

An example of the advantages obtained from the use of a multiband antenna in a real environment is the multilevel antenna AM1, described further below, used for GSM and DCS environments. These antennae are designed to meet radioelectric specifications in both cell phone systems. Using a single GSM and DCS multilevel antenna for both bands (900 MHz and 1800 MHz) cell telephony operators can reduce costs and environmental impact of their station networks while increasing the number of users' (customers) supported by the network.

It becomes particularly relevant to differentiate multilevel antennae from fractal antennae. The latter are based on fractal geometry, which is based on abstract mathematical concepts which are difficult to implement in practice. Specialized scientific literature usually defines as fractal those geometrical objects with a non-integral Haussdorf dimension. This means that fractal objects exist only as an abstraction or a concept, but that said geometries are unthinkable (in a strict sense) for a tangible object or drawing, although it is true that antennae based on this geometry have been developed and widely described in the scientific literature, despite their geometry not being strictly fractal in scientific terms. Nevertheless some of these antennae provide a multiband behaviour (their impedance and radiation diagram remains practically constant for several freq bands), they do not on their own offer all of the behaviour required of an antenna for applicability in a practical environment. Thus, Sierpinski's antenna for example has a multiband behaviour with N bands spaced by a factor of 2, and although with this spacing one could conceive its use for communications networks GSM 900 MHz and GSM 1800 MHz (or DCS), its unsuitable radiation diagram and size for these frequencies prevent a practical use in a real environment. In short, to obtain an antenna which in addition to providing a multiband behaviour meets all of the specifications demanded for each specific application it is almost always necessary to abandon the fractal geometry and resort for example to multilevel geometry antennae. As an example, none of the structures described in FIGS. 1, 3, 4, 5 and 6 are fractal. Their Hausdorff dimension is equal to 2 for all, which is the same as their topological dimension. Similarly, none of the multilevel structures of FIG. 7 are fractal, with their Hausdorff dimension equal to 3, as their topological dimension.

In any case multilevel structures should not be confused with arrays of antennae. Although it is true that an array is formed by sets of identical antennae, in these the elements are electromagnetically decoupled, exactly the opposite of what is intended in multilevel antennae. In an array each element is powered independently whether by specific signal transmitters or receivers for each element, or by a signal distribution network, while in a multilevel antenna the structure is excited in a few of its elements and the remaining ones are coupled electromagnetically or by direct contact (in a region which does not exceed 50% of the perimeter or surface of adjacent elements). In an array is sought an increase in the directivity of an individual antenna o forming a diagram for a specific application; in a multilevel antenna the object is to obtain a multiband behaviour or a reduced size of the antenna, which implies a completely different application from arrays.

Below are described, for purposes of illustration only, two non-limiting examples of operational modes for Multilevel Antennae (AM1 and AM2) for specific environments and applications.

Mode AM1

Figure 8:
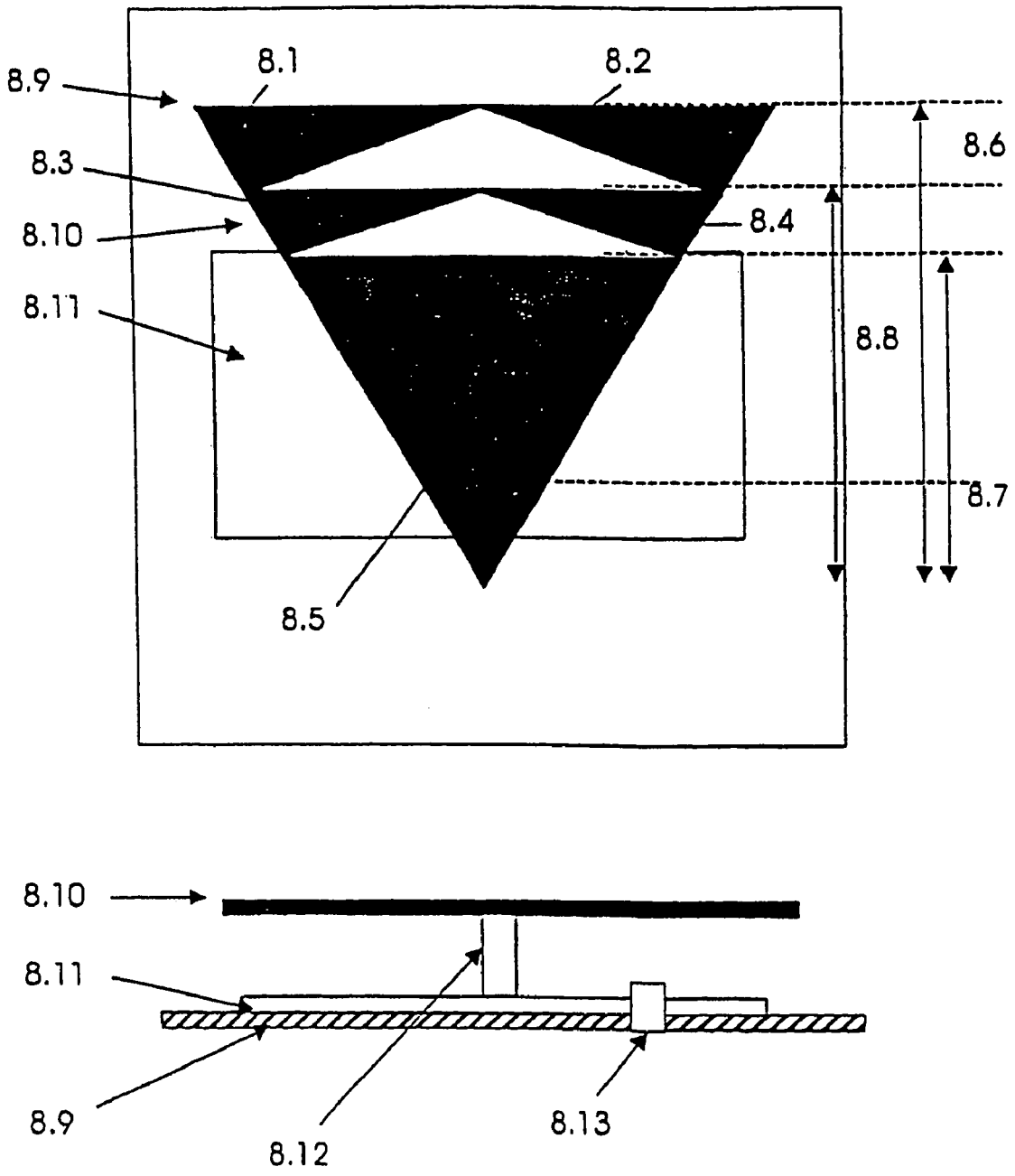
FIG. 8 shows an example of a specific operational mode for a multilevel antenna in a patch configuration for base stations of GSM (900 MHz) and DCS (1800 MHz) cellular telephony.

This model consists of a multilevel patch type antenna, shown in FIG. 8, which operates simultaneously in bands GSM 900 (890 MHz-960 MHz) and GSM 1800 (1710 MHz-1880 MHz) and provides a sector radiation diagram in a horizontal plane. The antenna is conceived mainly (although not limited to) for use in base stations of GSM 900 and 1800 mobile telephony.

The multilevel structure (8.10), or antenna patch, consists of a printed copper sheet on a standard fiberglass printed circuit board. The multilevel geometry consists of 5 triangles (8.1-8.5) joined at their vertices, as shown in FIG. 8, with an external perimeter shaped as an equilateral triangle of height 13.9 cm (8.6). The bottom triangle has a height (8.7) of 8.2 cm and together with the two adjacent triangles form a structure with a triangular perimeter of height 10.7 cm (8.8).

The multilevel patch (8.10) is mounted parallel to an earth plane (8.9) of rectangular aluminum of 22×18.5 cm. The separation between the patch and the earth plane is 3.3 cm, which is maintained by a pair of dielectric spacers which act as support (8.12).

Connection to the antenna is at two points of the multilevel structure, one for each operational band (GSM 900 and GSM 1800). Excitation is achieved by a vertical metal post perpendicular to the mass plane and to the multilevel structure, capacitively finished by a metal sheet which is electrically coupled by proximity (capacitive effect) to the patch. This is a standard system in patch configuration antennae, by which the object is to compensate the inductive effect of the post with the capacitive effect of its finish.

At the base of the excitation post is connected the circuit which interconnects the elements and the port of access to the antenna or connector (8.13). Said interconnection circuit may be formed with microstrip, coaxial or strip-line technology to name a few examples, and incorporates conventional adaptation networks which transform the impedance measured at the base of the post to so ohms (with a typical tolerance in the standing wave relation (SWR) usual for these application under 1.5) required at the input/output antenna connector. Said connector is generally of the type N or SMA for microcell base station applications.

In addition to adapting the impedance and providing an interconnection with the radiating element the interconnection network (8.11) may include a diplexor allowing the antenna to be presented in a two connector configuration (one for each band) or in a single connector for both bands.

For a double connector configuration in order to increase the insulation between the GSM 900 and GSM 1800 (DCS) terminals, the base of the DCS and excitation post may be connected to a parallel stub of electrical length equal to half a wavelength, in the central DCS wavelength, and finishing in an open circuit. Similarly, at the base of the GSM 900 lead can be connected a parallel stub ending in an open circuit of electrical length slightly greater than one quarter of the wavelength at the central wavelength of the GSM band. Said stub introduces a capacitance in the base of the connection which may be regulated to compensate the residual inductive effect of the post. Furthermore, said stub presents a very low impedance in the DCS band which aids in the insulation between connectors in said band.

Figure 9:
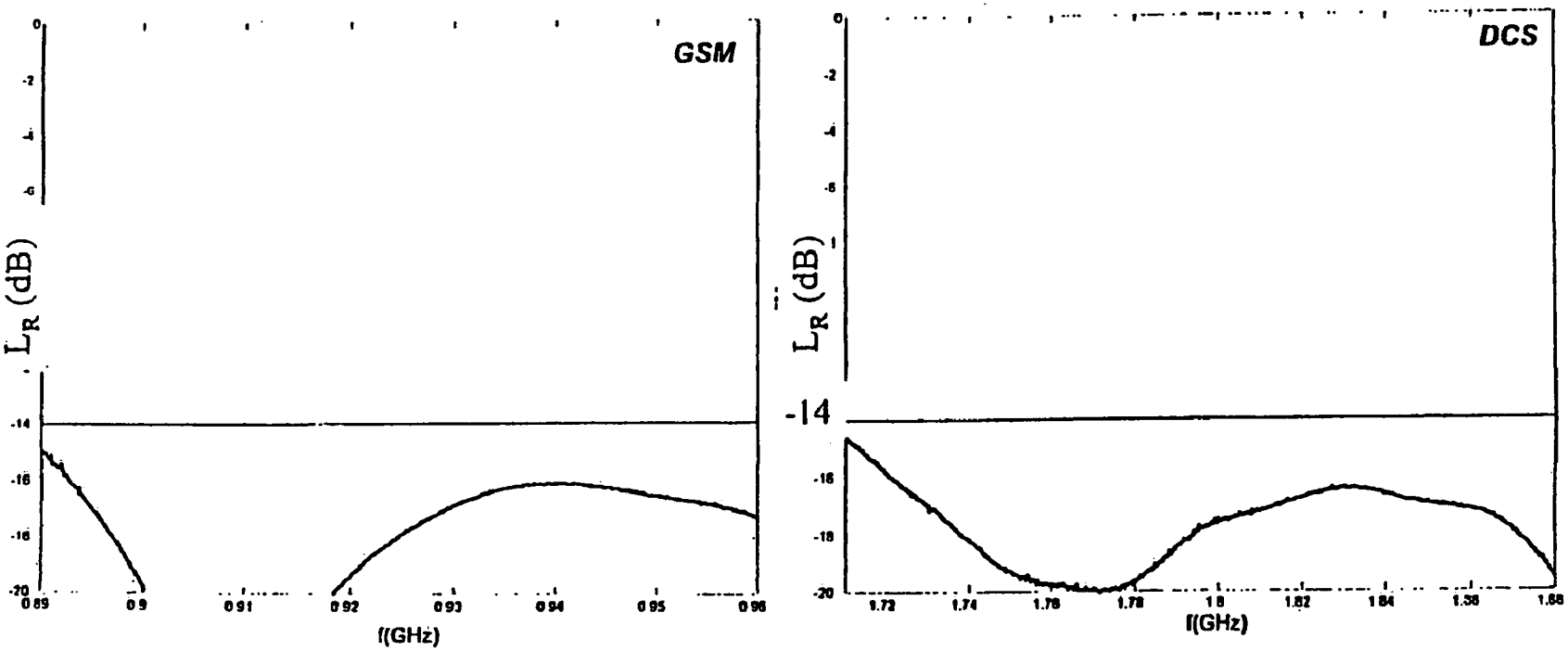
FIG. 9 shows input parameters (return loss on 50 ohms) for the multilevel antenna described in the previous figure.
Figure 10:
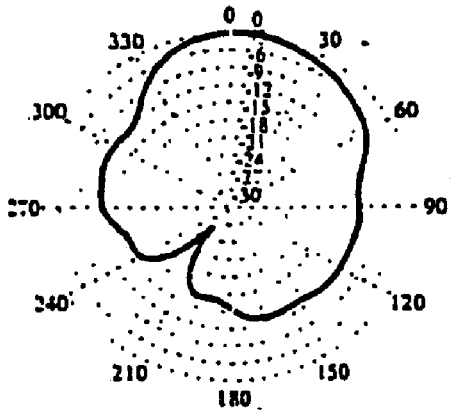
FIG. 10 shows radiation diagrams for the multilevel antenna of FIG. 8: horizontal and vertical planes.
Figure 10:
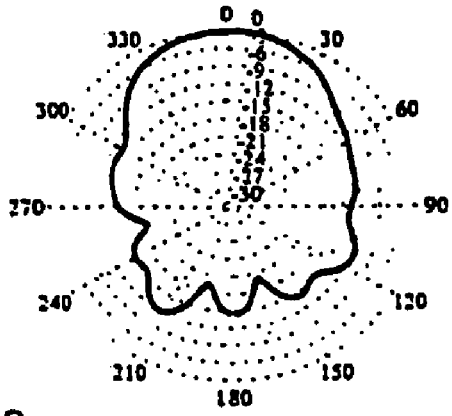
Figure 10:
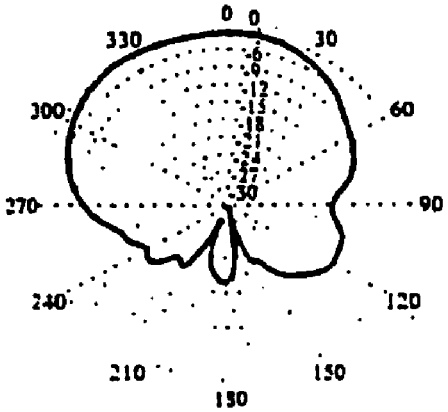
Figure 10:
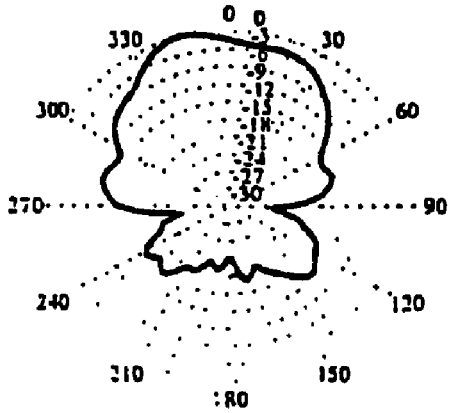

In FIGS. 9 and 10 are shown the typical radioelectric behavior for this specific embodiment of a dual multilevel antenna.

FIG. 9 shows return losses ($L_r$) in GSM (9.1) and DCS (9.2), typically under −14 dB (which is equivalent to SWR<1.5), so that the antenna is well adapted in both operation bands (890 MHz-960 MHz and 1710 MHz-1880 MHz).

Radiation diagrams in the vertical (10.1 and 10.3) and the horizontal plane (10.2 and 10.4) for both bands are shown in FIG. 10. It can be seen clearly that both antennae radiate using a main lobe in the direction perpendicular to the antenna (10.1 and 10.3), and that in the horizontal plane (10.2 and 10.4) both diagrams are sectorial with a typical beam width at 3 dB of 65°. Typical directivity (d) in both bands is d>7 Db.

Mode AM2

Figure 11:
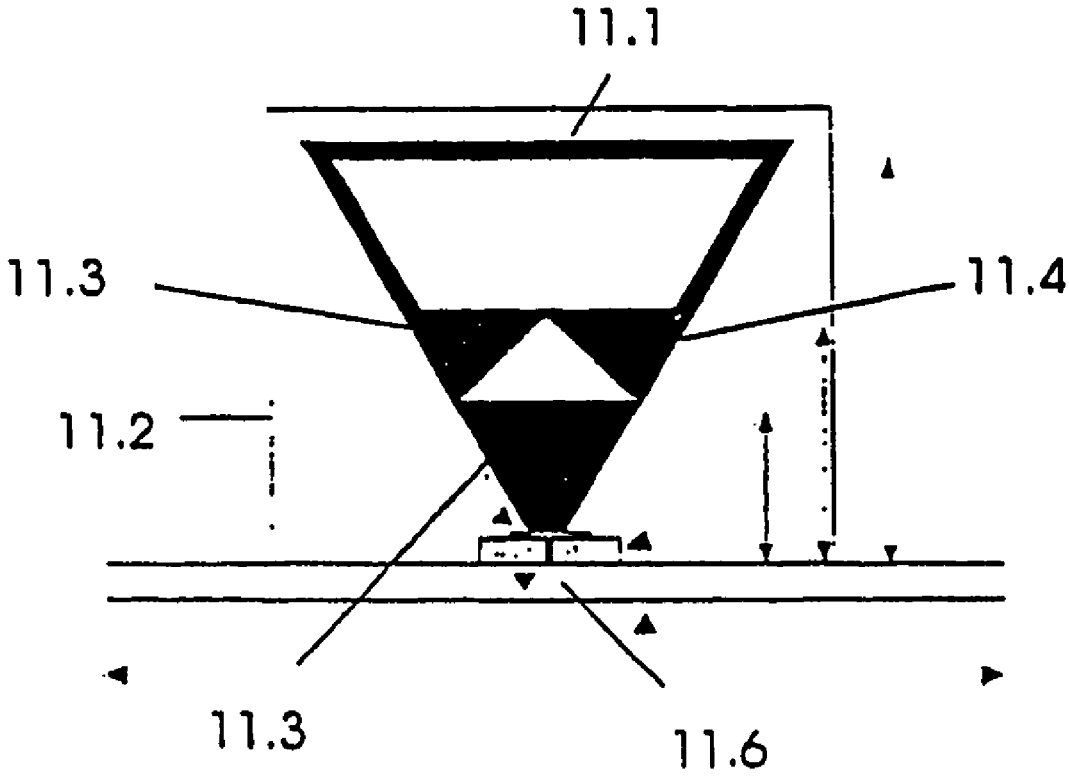
FIG. 11 shows an example of a specific operation mode for a multilevel antenna in a monopole construction for indoors wireless communication systems or in radio-accessed local network environments.

This model consists of a multilevel antenna in a monopole configuration, shown in FIG. 11, for wireless communications systems for indoors or in local access environments using radio.

The antenna operates in a similar manner simultaneously for the bands 1880 MHz-1930 MHz and 3400 MHz-3600 MHz, such as in installations with the system DECT. The multilevel structure is formed by three or five triangles (see FIGS. 11 and 3.6) to which may be added an inductive loop (11.1). The antenna presents an omnidirectional radiation diagram in the horizontal plane and is conceived mainly for (but not limited to) mounting on roof or floor.

The multilevel structure is printed on a Rogers® RO4003 dielectric substrate (11.2) of 5.5 cm width, 4.9 cm height and 0.8 mm thickness, and with a dielectric permittivity equal to 3.38 the multilevel element consists of three triangles (11.3-11.5) joined at the vertex; the bottom triangle (11.3) has a height of 1.82 cm, while the multilevel structure has a total height of 2.72 cm. In order to reduce the total size f the antenna the multilevel element is added an inductive loop (11.1) at its top with a trapezoidal shape in this specific application, so that the total size of the radiating element is 4.5 cm.

The multilevel structure is mounted perpendicularly on a metallic (such as aluminum) earth plane (11.6) with a square or circular shape about 18 cm in length or diameter. The bottom vertex of the element is placed on the center of the mass plane and forms the excitation point for the antenna. At this point is connected the interconnection network which links the radiating element to the input/output connector. Said interconnection network may be implemented as a microstrip, strip-line or coaxial technology to name a few examples. In this specific example the microstrip configuration was used. In addition to the interconnection between radiating element and connector, the network can be used as an impedance transformer, adapting the impedance at the vertex of the multilevel element to the 50 Ohms $L_r \leftarrow 14$ dB, SWR<1.5) required at the input/output connector.

Figure 12:
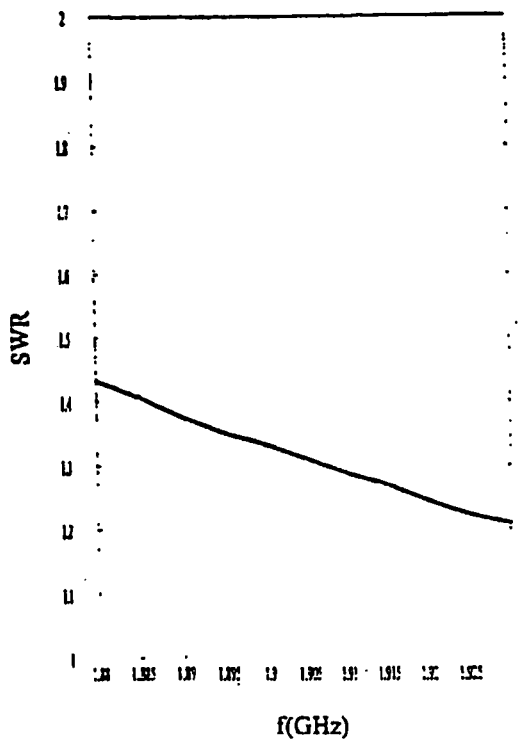
FIG. 12 shows input parameters (return loss on so ohms) for the multilevel antenna of the previous figure.
Figure 12:
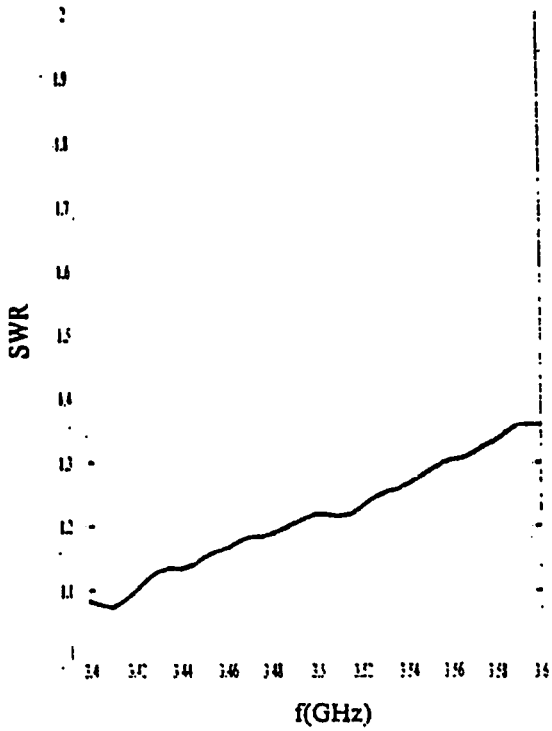
Figure 13:
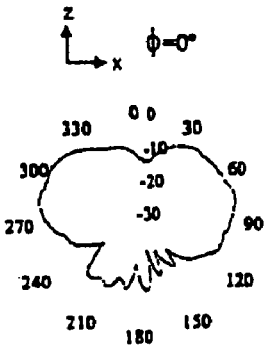
FIG. 13 shows radiation diagrams for the multilevel antenna of FIG. 11.
Figure 13:
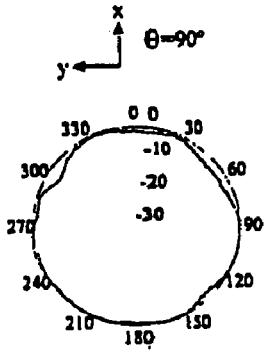
Figure 13:
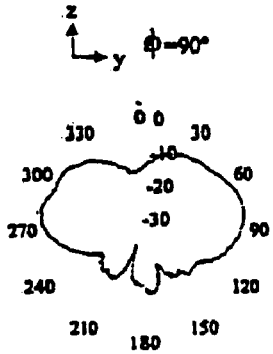
Figure 13:
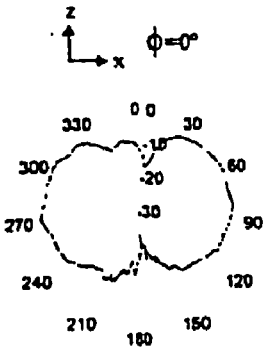
Figure 13:
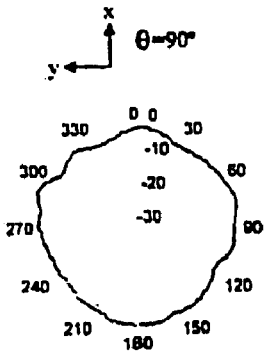
Figure 13:
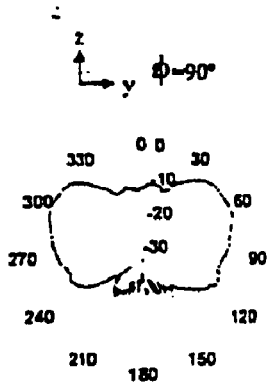

FIGS. 12 and 13 summarize the radioelectric behavior of antennae in the lower (1300) and higher bands (3500).

FIG. 12 shows the standing wave ratio (SWR) for both bands: FIG. 12.1 for the band between 1880 and 1930 MHz, and FIG. 12.2 for the band between 3400 and 3600 MHz. These show that the antenna is well adapted as return losses are under 14 dB, that is, SWR<1.5 for the entire band of interest.

FIG. 13 shows typical radiation diagrams. Diagrams (13.1), (13.2) and (13.3) at 1905 MHz measured in the vertical plane, horizontal plane and antenna plane, respectively, and diagrams (13.4), (13.5) and (13.6) at 3500 MHz measured in the vertical plane, horizontal plane and antenna plane, respectively.

One can observe an omnidirectional behaviour in the horizontal plane and a typical bilobular diagram in the vertical plane with the typical antenna directivity above 4 dBi in the 1900 band and 6 dBi in the 3500 band.

In the antenna behavior it should be remarked that the behavior is quite similar for both bands (both SWR and in the diagram) which makes it a multiband antenna.

Both the AM1 and AM2 antennae will typically be coated in a dielectric radome which is practically transparent to electromagnetic radiation, meant to protect the radiating element and the connection network from external aggression as well as to provide a pleasing external appearance.

It is not considered necessary to extend this description in the understanding that an expert in the field would be capable of understanding its scope and advantages resulting thereof, as well as to reproduce it.

However, as the above description relates only to a preferred embodiment, it should be understood that within this essence may be introduced various variations of detail, also protected, the size and/or materials used in manufacturing the whole or any of its parts.

The invention claimed is:

1. A multi-band antenna comprising:

a conductive radiating element including at least one multilevel structure, said at least one multilevel structure comprising a plurality of electromagnetically coupled geometric elements, said plurality of geometric elements including at least two portions, a first portion being associated with a first selected frequency band and a second portion being associated with a second selected frequency band, said second portion being located substantially within the first portion, said first and second portions defining empty spaces in an overall structure of the conductive radiating element to provide a circuitous current path within the first portion and within the second portion, and the current within said first portion providing said first selected frequency band with radio electric behavior substantially similar to the radio electric behavior of said second selected frequency band and the current within the second portion providing said second selected frequency band with radio electric behavior substantially similar to the radio electric behavior of said first selected frequency band.

2. The multi-band antenna as set forth in claim 1, wherein geometrics of at least some of the plurality of geometric elements overlap in the area in which perimeters of said geometric elements are interconnected.

3. The multi-band antenna as set forth in claim 1, wherein at least some of the plurality of geometric elements have perimeter regions comprising linear portions.

4. The multi-band antenna as set forth in claim 1, wherein at least some of the plurality of geometric elements have perimeter regions comprising a curve.

5. The multi-band antenna as set forth in claim 1, wherein at least some of the plurality of geometric elements have perimeter regions comprising both linear and non-linear portions.

6. The multi-band antenna as set forth in claim 1, wherein more than two geometric elements are included in said plurality of geometric elements.

7. The multi-band antenna as set forth in claim 1, wherein more than four geometric elements are included in said plurality of geometric elements.

8. The multi-band antenna as set forth in claim 1, wherein more than twelve geometric elements are included in said plurality of geometric elements.

9. The multi-band antenna set forth in claim 1, wherein the antenna has a small size compared to a circular, square or triangular antenna whose perimeter can be circumscribed in the multilevel structure and which operates at the lowest frequency band of the multi-band antenna.

10. The multi-band antenna set forth in claim 1, wherein the antenna has a small size compared to a single-polygon antenna whose perimeter can be circumscribed in the multilevel structure and which operates at the lowest frequency band of the multi-band antenna.

11. The multi-band antenna set forth in claim 1, wherein at least a portion of said at least one multilevel structure comprises a printed copper sheet on a printed circuit board.

12. The multi-band antenna set forth in claim 1, wherein said antenna is included in a portable communications device.

13. The multi-band antenna set forth in claim 12, wherein said portable communication device is a handset.

14. The multi-band antenna set forth in claim 13, wherein said antenna operates at multiple frequency bands, and wherein at least one of said frequency bands is operating within the 800 MHz-3600 MHz frequency range.

15. The multi-band antenna set forth in claim 13, wherein a number of operating bands of the handset is proportional to the number of levels within said multilevel structure.

16. The multi-band antenna set forth in claim 13, wherein a number of operating bands is proportional to a number of portions of electromagnetically coupled geometrical elements within said multilevel structure.

17. The multi-band antenna set forth in claim 13, wherein said antenna operates at multiple frequency bands, and wherein at least one of said frequency bands is used by at least a GSM or UMTS communication service.

18. The multi-band antenna of claim 1, wherein the first and second portions are further comprised of a plurality of geometric elements.

19. The multi-band antenna of claim 1, wherein the first and second portions each comprise a single geometric element.

20. The multi-band antenna of claim 1, wherein the radiating element defines a periphery having an edge rich structure that increases the radiation resistance of the multilevel antenna and increases a bandwidth of the multilevel antenna in at least one of the operating frequency bands of the multilevel antenna.

21. The multi-band antenna of claim 1, wherein the empty spaces force the current to travel a greater distance resulting in an associated frequency lower than a resonance frequency of a radiating structure not including said empty spaces.

22. A multi-band antenna according to claim 1, wherein the region of contact or overlap between adjacent geometric elements forming said multilevel structure is smaller than 50% of the perimeter for at least the majority of the elements forming said multilevel structure.

23. A multi-band antenna according to claim 1, wherein the overall multilevel structure and the first portion of geometric elements associated with a first frequency band have the same antenna configuration, wherein said antenna configuration can be selected from the group consisting essentially of: monopole, dipole, patch antenna, microstrip antenna, coplanar antenna, reflector, horn, loop, spiral, and aperture antenna.

24. A multi-band antenna according to claim 1, wherein the multilevel structure is included in at least a portion of a patch element in a patch antenna.

25. A multi-band antenna according to claim 24, wherein the patch element comprising said multilevel structure is mounted substantially parallel to a ground plane.

26. A multi-band antenna according to claim 24, wherein the connection to the antenna is made at least at two points of the multilevel structure.

27. A multi-band antenna according to claim 1, wherein the antenna element comprising said multilevel structure is stamped on a metal support chosen from the group consisting essentially of a metal sheet and a metal plate.

28. A multi-band antenna according to claim 1, wherein the antenna is a patch antenna that operates at least in the GSM 900 MHz and the DCS 1800 MHz frequency bands.

29. A multi-band antenna according to claim 1, wherein the antenna is designed to operate at least at one or more frequencies above 1880 MHz.

30. A multi-band antenna according to claim 1, wherein the antenna operates at three or more frequency bands and the antenna is shared by three or more cellular services.

31. A multi-band antenna according to claim 1, wherein the multilevel structure is connected to at least one of a matching network, a filter, and a diplexer.

32. A multi-band antenna according to claim 1, wherein the multilevel structure is loaded with a capacitive or inductive element to modify at least one of size, resonant frequency, radiation pattern, or impedance.

33. A multi-band antenna, comprising:

a conductive radiating element including at least one multilevel structure, said at least one multilevel structure including at least two levels of detail in its geometric structure, a first level of detail being formed by a plurality of electromagnetically coupled geometric elements, said geometric elements including a first group of the geometric elements associated with a first selected frequency band and a second group of the geometric elements associated with a second selected frequency band, at least some of the geometric elements comprising said first group being included within the geometric elements comprising said second group, a second level of detail being formed by an overall geometric shape of said multilevel structure, said overall geometric shape of said structure defining an edge rich perimeter, and said first group of the geometric elements and said second group of the geometric elements defining empty spaces in the overall geometric structure to provide a circuitous current path for a current associated with at least one of the first and second groups of the geometric elements, said current path associated with one of the first and second selected frequency bands of the structure and having a lower frequency than a structure not including said empty spaces.

34. A multi-band antenna comprising:

a conductive radiating element including at least one multilevel structure, said at least one multilevel structure including a plurality of electromagnetically coupled geometric elements, said geometric elements including at least two portions on said multilevel structure, a first portion associated with a first selected frequency band and a second portion associated with a second selected frequency band, wherein the majority of the geometric elements of said second portion are included within the geometric elements comprising said first portion, said first portion and said second portion defining empty spaces in an overall structure of the conductive radiating element to provide circuitous current paths within said first and second portions, a perimeter of the multilevel structure defining an edge rich periphery, and wherein the overall structure of said conductive radiating element has a smaller size than a circular, square, or triangular antenna whose perimeter can be circumscribed within the periphery of the overall structure and operates in at least one of the first and second selected frequency bands.

35. A multi-band antenna comprising:

a conductive radiating element including at least one multilevel structure, said at least one multilevel structure including a plurality of electromagnetically coupled geometric elements, said geometric elements including at least two portions, a first portion of the geometric elements associated with a first selected frequency band and a second portion of the geometric elements associated with a second selected frequency band, wherein said second portion is located substantially within the first portion, said first portion and said second portion defining empty spaces in an overall structure of the conductive radiating element to provide circuitous current paths within said first and second portions, a perimeter of the multilevel structure defining an edge rich periphery that increases the radiation resistance of the antenna in at least one of said selected frequency bands, and wherein the overall structure of said conductive radiating element has a smaller size than a circular, square, or triangular antenna whose perimeter can be circumscribed within the overall structure and which operates in at least one of the first and second selected frequency bands.

36. A multi-band antenna comprising:

a conductive radiating element including at least one multilevel structure, said at least one multilevel structure including a plurality of electromagnetically coupled geometric elements, the plurality of geometric elements including at least a first portion and a second portion, wherein the said first portion is associated with a first selected frequency band, and the said second portion is associated with a second selected frequency band, said first portion and said second portion defining empty spaces in an overall structure of the conductive radiating element to provide a current path for a current in at least one of the first portion and the second portion, said current path being associated with one of said selected frequency bands and having a lower frequency of resonance than a radiating structure not including said empty spaces, and a perimeter of the multi-level structure defining an edge rich structure that enhances the radiation process of the antenna.

37. A multi-band antenna, comprising:

a conductive radiating element including at least one multilevel structure, said at least one multilevel structure including at least two levels of detail in its geometric structure, a first level of detail being formed by a plurality of geometric electromagnetically coupled geometric elements, said plurality of geometric elements including at least a first portion of geometric elements associated with a first selected frequency band, a second level of detail being formed by an overall geometric shape of the structure, said overall geometric shape being associated with a second selected frequency band, said overall geometric shape of the structure defining an edge rich perimeter that enhances the radiation process, said plurality of geometric elements defining empty spaces in the overall structure to provide a current path for a current associated with at least one of said portions of the plurality of geometric elements and the overall structure, and said current path being associated with one of said frequency bands of the antenna and having a lower frequency than a structure not including said empty spaces.

* * * * *

Disclaimer

7,397,431 B2 — Carles Puente Baliarda, Barcelona (ES); Carmen Borja Borau, Barcelona (ES); Jaume Anguera Pros, Barcelona (ES); and Jordi Soler Castany, Mataro (ES). MULTILEVEL ANTENNAE. Patent dated Jul. 8, 2008. Disclaimer filed September 10, 2013, by the assignee, Fractus, S.A.

Hereby disclaim the following complete claims 1, 4, 5, 7, 8, 12, 13, 17, 21, 22, 24-27, 29 and 31 of said patent.

*(Official Gazette, November 12, 2013)*

US007397431C1

(12) EX PARTE REEXAMINATION CERTIFICATE (10557th)

United States Patent
Baliarda et al.

(10) Number: US 7,397,431 C1
(45) **Certificate Issued: *Mar. 31, 2015**

(54) MULTILEVEL ANTENNA

(75) Inventors: Carles Puente Baliarda, Barcelona (ES); Carmen Borja Borau, Barcelona (ES); Jaume Anguera Pros, Barcelona (ES); Jordi Soler Castany, Mataro (ES)

(73) Assignee: Fractus, S.A., Barcelona (ES)

Reexamination Request:
No. 90/013,023, Oct. 9, 2013

Reexamination Certificate for:

| | |
|---|---|
| Patent No.: | **7,397,431** |
| Issued: | **Jul. 8, 2008** |
| Appl. No.: | **11/179,257** |
| Filed: | **Jul. 12, 2005** |

( * ) Notice: This patent is subject to a terminal disclaimer.

Related U.S. Application Data

(63) Continuation of application No. 11/102,390, filed on Apr. 8, 2005, now Pat. No. 7,123,208, which is a continuation of application No. 10/963,080, filed on Oct. 12, 2004, now Pat. No. 7,015,868, which is a continuation of application No. 10/102,568, filed on Mar. 18, 2002, now abandoned, which is a continuation of application No. PCT/ES99/00296, filed on Sep. 20, 1999.

(51) Int. Cl.

| | |
|---|---|
| ***H01Q 1/24*** | (2006.01) |
| ***H01Q 1/50*** | (2006.01) |
| ***H01Q 1/36*** | (2006.01) |

(52) U.S. Cl.
CPC ... *H01Q 1/50* (2013.01); *H01Q 1/36* (2013.01)
USPC ..... 343/702; 343/700 MS; 343/800

(58) Field of Classification Search
CPC ..... H01Q 1/50; H01Q 1/36
USPC ..... 343/702, 700 MS, 800
See application file for complete search history.

(56) References Cited

To view the complete listing of prior art documents cited during the proceeding for Reexamination Control Number 90/013,023, please refer to the USPTO's public Patent Application Information Retrieval (PAIR) system under the Display References tab.

*Primary Examiner* — Linh M Nguyen

(57) ABSTRACT

Antennae in which the corresponding radiative element contains at least one multilevel structure formed by a set of similar geometric elements (polygons or polyhedrons) electromagnetically coupled and grouped such that in the structure of the antenna can be identified each of the basic component elements. The design is such that it provides two important advantages: the antenna may operate simultaneously in several frequencies, and/or its size can be substantially reduced. Thus, a multiband radioelectric behavior is achieved, that is, a similar behavior for different frequency bands.

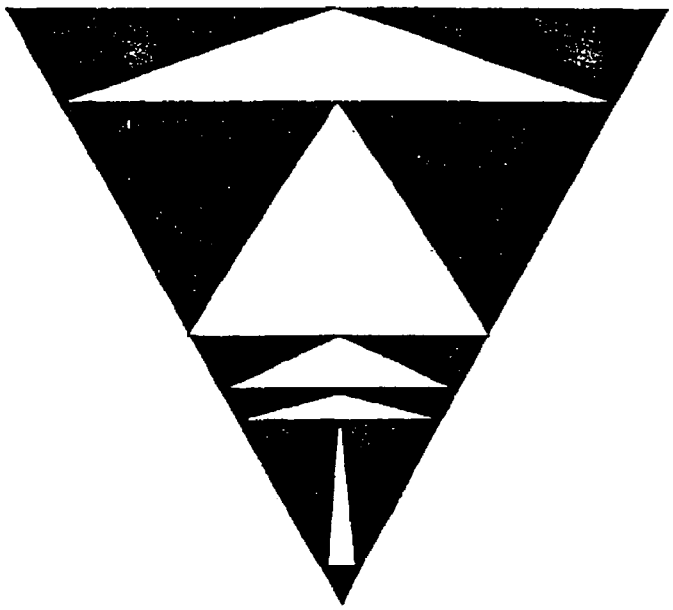

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 4, 5, 7, 8, 12, 13, 17, 21, 22, 24-27, 29 and 31 were previously disclaimed.

Claims 14 and 30 are determined to be patentable as amended.

New claims 38-43 are added and determined to be patentable.

Claims 2, 3, 6, 9-11, 15, 16, 18-20, 23, 28 and 32-37 were not reexamined.

14. The multi-band antenna set forth in claim 13, wherein said antenna operates at multiple frequency bands, and wherein at least one of said frequency bands is operating within the 800 MHz-3600 MHz frequency range[.] *, wherein:*

*the first portion is a first level of structural detail comprising the overall structure and having a first geometry configured to operate at the first selected frequency band;*

*the second portion is a second level of structural detail within the first level of structural detail, the second portion being smaller than the first portion and having a second geometry configured to operate at the second selected frequency band; and*

*the perimeter of the multilevel structure has a different number of sides than each of the geometric elements that compose the multilevel structure.*

30. A multi-band antenna according to claim 1, wherein the antenna operates at three or more frequency bands and the antenna is shared by three or more cellular services[.] *, wherein:*

*the first portion is a first level of structural detail comprising the overall structure and having a first geometry configured to operate at the first selected frequency band;*

*the second portion is a second level of structural detail within the first level of structural detail, the second portion being smaller than the first portion and having a second geometry configured to operate at the second selected frequency band; and*

*the perimeter of the multilevel structure has a different number of sides than each of the geometric elements that compose the multilevel structure.*

*38. The multiband antenna of claim 14, wherein the perimeter of the multilevel structure has a greater number of sides than each of the geometric elements that compose the multilevel structure.*

*39. The multiband antenna of claim 38, wherein the geometry of the first portion shapes the circuitous current path within the first portion to cause the first portion to operate at the first selected frequency band.*

*40. The multiband antenna of claim 38, wherein the geometry of the second portion shapes the circuitous current path within the second portion to cause the second portion to operate at the second selected frequency band.*

*41. The multiband antenna of claim 30, wherein the perimeter of the multilevel structure has a greater number of sides than each of the geometric elements that compose the multilevel structure.*

*42. The multiband antenna of claim 41 wherein the geometry of the first portion shapes the circuitous current path within the first portion to cause the first portion to operate at the first selected frequency band.*

*43. The multiband antenna of claim 41, wherein the geometry of the second portion shapes the circuitous current path within the second portion to cause the second portion to operate at the second selected frequency band.*

* * * * *